US007810526B2

(12) United States Patent
Yamashita

(10) Patent No.: US 7,810,526 B2
(45) Date of Patent: Oct. 12, 2010

(54) INSERT RAPIER

(75) Inventor: Ryoji Yamashita, Kanazawa (JP)

(73) Assignee: Tsudakoma Kogyo Kabushiki Kaisha, Kanazawa-shi (JP)

( * ) Notice: Subject to any disclaimer, the term of this patent is extended or adjusted under 35 U.S.C. 154(b) by 0 days.

(21) Appl. No.: 12/691,332

(22) Filed: Jan. 21, 2010

(65) Prior Publication Data

US 2010/0206423 A1 Aug. 19, 2010

(30) Foreign Application Priority Data

Feb. 16, 2009 (JP) ..... 2009-033065

(51) Int. Cl.
*D03D 47/20* (2006.01)
*D03D 47/23* (2006.01)
*D03D 47/00* (2006.01)
*D03D 47/24* (2006.01)

(52) U.S. Cl. ..... 139/448; 139/449

(58) Field of Classification Search ..... 139/448, 139/449

See application file for complete search history.

(56) References Cited

U.S. PATENT DOCUMENTS 3,602,266 A * 8/1971 Duplessy ..... 139/446
3,844,316 A * 10/1974 Palencher ..... 139/429
3,861,427 A * 1/1975 Scheidecker ..... 139/448
3,931,837 A * 1/1976 Volpe ..... 139/448
4,226,265 A * 10/1980 Zollinger ..... 139/448
4,699,183 A * 10/1987 Menzel ..... 139/449
4,785,856 A * 11/1988 Gehring et al. ..... 139/453
5,318,077 A * 6/1994 Yamashita ..... 139/449
5,415,206 A * 5/1995 Egloff ..... 139/196.2
5,862,837 A * 1/1999 Guenther et al. ..... 139/448
6,845,792 B2 * 1/2005 Scari et al. ..... 139/448
2003/0183297 A1 * 10/2003 Scari et al. ..... 139/448
2008/0105326 A1 * 5/2008 D'Incau et al. ..... 139/448

FOREIGN PATENT DOCUMENTS

JP 46-20112 A 6/1971
JP 2-269835 A 11/1990

* cited by examiner

*Primary Examiner*—Bobby H Muromoto, Jr.
(74) *Attorney, Agent, or Firm*—Westerman, Hattori, Daniels & Adrian, LLP

(57) ABSTRACT

An insert rapier includes a weft-holding portion at a bottom portion of a rapier head. Rear and front walls are provided at a distal side of the rapier head with respect to the weft-holding portion and protruding from both sides of the bottom portion, thereby having a warp-dividing function. The insert rapier can guide a weft, which intersects with warps at a predetermined angle, to the weft-holding portion. The rapier head includes a tongue piece provided at the distal side with respect to the weft-holding portion, in a region between the weft-holding portion and the rear wall. The tongue piece has a distal tip located lower than the rear wall, and has an upper ridge gradually ascending from the distal tip toward a proximal side. The tongue piece is movable to a position above the rapier head or toward the proximal side.

14 Claims, 20 Drawing Sheets

INSERT RAPIER

BACKGROUND OF THE INVENTION

1. Field of the Invention

The present invention relates to an insert rapier used for a both-side rapier loom.

2. Description of the Related Art

Weft insertion for a both-side rapier loom is typically performed by an insert rapier provided at a weft-feeding side and a carrier rapier provided at a side opposite to the weft-feeding side. The insert rapier holds the distal end of a weft connecting with a weft feeder, and carries the weft in a shed of warps to the center of the weaving-width. At this position, the weft is transferred to a carrier rapier inserted into the shed in the direction opposite to the weft-feeding direction. The carrier rapier carries the weft to the side opposite to the weft-feeding side.

The insert rapier may have a configuration in which a weft is spontaneously transferred by relative movement of the insert rapier and the carrier rapier (for example, see Japanese Unexamined Patent Application Publication No. 02-269835). To stably perform the weft insertion, the insert rapier needs to have a function of holding a weft, and a function of dividing warps so as not to incorrectly hold a warp (in particular, a defectively shed warp) during traveling in the shed of warps.

FIG. 16 illustrates an example of an insert rapier of related art used for a both-side rapier loom. In this specification, the side of the insert rapier which is advanced into the shed of warps first is the distal side (the weft-insertion side) and the side thereof which is retracted from the shed of warps first is the proximal side (the side opposite to the weft-insertion side). An insert rapier 81 includes a weft-holding portion 83 arranged at a bottom portion 85 of a rapier head 82. The weft-holding portion 83 holds a weft 20. The weft-holding portion 83 includes a catch base 83*a* and a catch piece 83*b* which are vertically arranged and respectively have facing surfaces 83*f* and 83*e* facing one another. A gap is defined between the facing surfaces 83*f* and 83*e* of the catch base 83*a* and the catch piece 83*b*. The gap is narrowed from the distal side toward the proximal side of the insert rapier 81. Thus, the gap defines a wedge-shaped gap 83*c* between the facing surfaces 83*f* and 83*e*. The gap 83*c* can hold the weft 20. One of the catch base 83*a* and the catch piece 83*b* is elastically pressed to the other, so as to pinch and hold the weft 20 by the gap 83*c* when the weft 20 is guided to the position between the catch base 83*a* and the catch piece 83*b*. When the weft 20 is transferred to a carrier rapier, the weft 20 is allowed to be pulled out of the gap 83*c* of the weft-holding portion 83.

A warp-dividing portion for dividing warps is provided at the distal side (the weft-insertion side) of the rapier head 82 with respect to the weft-holding portion 83. More specifically, a front wall 86 and a rear wall 87 of the rapier head 82, and a tongue piece 88 provided at the distal side of a head cover 80 define an upper warp-dividing portion. A lower surface of the bottom portion 85 of the rapier head 82 defines a lower warp-dividing portion. The front wall 86 and the rear wall 87 are provided in a region at the distal side of the rapier head 82 with respect to the weft-holding portion 83. The front wall 86 and the rear wall 87 protrude upward from both sides in the width direction of the bottom portion 85 of the rapier head 82, and have hill-like shapes extending in the longitudinal direction of the insert rapier 81. The front wall 86 and the rear wall 87 respectively have ridge portions including an upper ridge 86*b* having a top 86*a*, and an upper ridge 87*b* having a top 87*a*. A distal half portion of the front wall 86 overlaps with the rear wall 87 in a side view of the rapier head 82 (in the warp direction). Also, an upper guide portion 84*a* and a lower guide portion 84*b* are provided at the distal side of the rapier head 82 with respect to the bottom portion 85. The upper guide portion 84*a* and the lower guide portion 84*b* are tapered in the up-down direction (the thickness direction) and the front-rear direction, and converge at a distal tip 84. The upper guide portion 84*a* and the lower guide portion 84*b* connect with the upper and lower surfaces of the bottom portion 85.

The rapier head 82 includes the head cover 80 that tenses the weft 20 to allow the weft 20 to be transferred to the carrier rapier. The tongue piece 88 that is integrated with the head cover 80 has a distal portion 88*d* extending in the weft-insertion direction, i.e., in a direction in which the weft 20 is inserted. The distal portion 88*d* of the tongue piece 88 is located lower than the top 87*a* of the rear wall 87 in the side view of the rapier head 82, and located in a region between the front wall 86 and the rear wall 87 in a top view of the rapier head 82. The tongue piece 88 gradually descends toward the distal portion 88*d* located at the distal side while the extending direction is gradually shifted in the front direction toward the distal side with respect to the weft-holding portion 83.

FIGS. 17 to 19 illustrate the state in which the rapier head 82 introduces the weft 20 when the weft-holding portion 83 holds the weft 20. By traveling of the insert rapier 81, the weft 20 that extends to intersect with the warp direction at a predetermined angle to a warp direction (FIG. 17) contacts the upper ridge 87*b* of the rear wall 87, then contacts the upper ridge 86*b* of the front wall 86 while being in contact with the upper ridge 87*b* of the rear wall 87, and then is separated from the upper ridge 87*b* of the rear wall 87 while being in contact with the upper ridge 86*b* of the front wall 86. The weft 20 is moved toward the proximal side relative to the insert rapier 81. In the course of the movement, the weft 20 reaches the distal portion 88*d* of the tongue piece 88 (FIG. 18). The shapes of the front wall 86, the rear wall 87, and the tongue piece 88 are determined such that the distal portion 88*d* of the tongue piece 88 is located higher than the weft 20 that obliquely extends in the region between the front wall 86 and the rear wall 87 in a top view. Thus, the weft 20 enters a gap 89 between the rear wall 87 and the tongue piece 88. When the insert rapier 81 moves, the weft 20 is relatively moved in the direction opposite to the weft-insertion direction (toward the proximal side) within the gap 89, and is guided to the weft-holding portion 83. The weft 20 is tucked into the space between the two members (the catch base 83*a* and the catch piece 83*b*) of the weft-holding portion 83 and held by the two members (FIG. 19).

FIGS. 20 to 22 each illustrate the state in which the insert rapier 81 divides defectively shed warps 21 during weft insertion. The warps 21 that form a shed are orthogonal to the weft-insertion direction (the advance direction of the insert rapier 51) (FIG. 20). If incompletely shed warps 21 are produced due to entangled fluff, when the insert rapier 81 moves, the defectively shed warps 21 on the travel path of the insert rapier 81 are moved toward the proximal side relative to the insert rapier 81 while being in contact with one of the upper ridges 86*b* and 87*b* of the front and rear walls 86 and 87. The warps 21 reach the distal portion 88*d* of the tongue piece 88 (FIG. 21). The shapes of the front wall 86, the rear wall 87, and the tongue piece 88 are determined such that the distal portion 88*d* of the tongue piece 88 is located lower than the warps 21 that extend between the front wall 86 and the rear wall 87. Accordingly, the defectively shed warp 21 contacts an upper ridge 88*b* of the tongue piece 88. When the insert rapier 81 moves, the warp 21 is tossed upward by the upper ridge 88*b* of the tongue piece 88 and an upper ridge of the head cover 80. Thus, the warps 21 pass above the insert rapier 81 without entering the waft holding portion 83 (FIG. 22).

The insert rapier 81 causes the weft 20 to be held by tucking the weft 20 into the region between the two members (the catch base 83*a* and the catch piece 83*b*) which are elastically pressed to one another. When the weft 20 is transferred to the carrier rapier, the insert rapier 81 causes the weft 20 to be released by relatively retracting the carrier rapier, to which the weft 20 has been transferred, so that the weft 20 is spontaneously pulled out of the two members (the catch base 83*a* and the catch piece 83*b*). Also, the function of dividing the warps 21 and introducing only the weft 20 to the weft-holding portion 83 is realized on the basis of the angle of the weft and the positional relationship among the front wall 86, the rear wall 87, and the tongue piece 88 provided at the rapier head 82. As described above, the weft 20 can be held and transferred (released) with the simple configuration, while the warps, in particular, the incompletely shed warps 21 can be prevented from being incorrectly held by the weft-holding portion 83.

As described above, the insert rapier 81 causes the weft 20 to be held by tucking the weft 20 into the region between the two members (the catch base 83*a* and the catch piece 83*b*) which are elastically pressed to one another. For example, in a case in which an entirely disconnected (easily separated) weft 20, such as a multifilament yarn made of a large number of monofilaments, is held, the entire weft 20 is pressed by the facing surfaces 83*e* and 83*f* of the two members. The filaments of the weft 20 may be tucked into the wedge-shaped gap 83*c* while being separated in a plane. Also, the holding force for the filaments becomes small at the position at which the gap is large. Bending stress may be intensively exerted on filaments which are relatively completely held from among the filaments. Consequently, the filaments may be broken, or the weft 20 may be split while the insert rapier 81 travels after the insert rapier 81 holds the weft 20.

Also, in the insert rapier 81, the gap 89 between the rear wall 87 and the tongue piece 88 is as narrow as possible to prevent the warps 21 from incorrectly entering the weft-holding portion 83. Owing to this, the entirely disconnected weft 20 or a weft having a special shape (a tape-like weft with a large width, such as a flat yarn) may be entirely hooked to the tongue piece 88 and may not enter the narrow gap 89. The weft 20 may not be guided to the weft-holding portion 83, and hence, the weft-holding portion 83 may not catch the weft 20. The productivity of woven fabric may be degraded.

Meanwhile, an insert rapier of related art may include a weft-holding portion that is actively opened and closed (Japanese Examined Patent Application Publication No. 46-20112). The insert rapier includes a base surface provided at the distal side of a holding head (corresponding to a rapier head in this specification), and a holding lever (corresponding to a catch lever in this specification) that has a facing surface facing the base surface and is urged to press the base surface. The holding lever is actively opened and closed to allow a weft to be held between the base surface and the facing surface before weft insertion. However, since the weft-holding portion (the holding lever) is provided at the distal side of the insert rapier, a size residue and dust tend to remain at the weft-holding portion. The engagement between the holding head and the holding lever may be insufficient. If the rapier head enters the shed of warps while the weft-holding portion provided at the distal end of the rapier head is even slightly opened, an incompletely shed warp due to entangled fluff may be hooked to the rapier head, and the warp may be cut.

SUMMARY OF THE INVENTION

In light of the situations, an object of the present invention is to improve an insert rapier that can guide only a weft to a weft-holding portion by using a rear wall, a front wall, and a head cover, and spontaneously transfer the weft when a carrier rapier is relatively retracted. In particular, an object of the present invention is to provide an insert rapier that can reliably guide a weft to a weft-holding portion and hold the weft by the weft-holding portion without the weft being damaged, when the weft is, for example, an entirely disconnected (easily separated) weft like a multifilament yarn made of a large number of monofilaments, or a tape-like special weft with a large width like a flat yarn. Also, the insert rapier can divide warps even if the warps are incompletely shed due to entangled fluff or the like.

An insert rapier according to an aspect of the present invention is provided. The insert rapier is used for a both-side rapier loom and transfers a weft to a carrier rapier. The insert rapier has the following configuration. The insert rapier includes a rapier head having a bottom portion; and a weft-holding portion provided at the bottom portion of the rapier head. The rapier head includes hill-like rear and front walls provided at a distal side of the rapier head with respect to the weft-holding portion and protruding upward from both sides of the bottom portion of the rapier head, and a tongue piece extending from a position closer to the weft-holding portion than the rear and front walls to a region between the rear and front walls. The front and rear walls partly overlap with one another in a side view of the rapier head. A distal tip of a distal portion of the tongue piece is located in the overlapping region. An upper ridge of the distal portion of the tongue piece gradually ascends from the distal tip of the tongue piece toward a proximal side of the tongue piece. The front wall, the rear wall, and the tongue piece define a warp-dividing portion. The tongue piece of the insert rapier is movable from a standby position to a retracted position, which is above the rapier head or at a distal side of the rapier head, in the side view of the rapier head. The tongue piece is moved to the retracted position before the weft passes the distal tip of the tongue piece.

The tongue piece may be provided at a distal end of a lever that is rotatable in an up-down direction.

The weft-holding portion may include a catch base provided at the bottom portion of the rapier head and having a base surface, and a catch piece having a lower surface that faces the base surface of the catch base, the catch piece configured to hold the weft between the base surface and the lower surface. The catch piece may be provided as the lever that is rotatable in the up-down direction. The tongue piece may be provided at a side of the catch piece.

The distal portion of the tongue piece may have a lower ridge extending from the distal tip of the tongue piece toward the distal side, the lower ridge of the tongue piece continuously extending to a lower ridge of the catch piece in the side view of the rapier head.

A wedge-shaped gap may be formed between the base surface of the catch base and the lower surface of the catch piece, the gap being open in an advance direction and configured to hold the weft. The wedge-shaped gap may be configured to be expanded because the lower surface of the catch piece is separated from the base surface of the catch base when the tongue piece is moved to the retracted position. A weft stopper may be provided at a side of the catch base, the weft stopper configured to determine a holding position of the weft in the wedge-shaped gap, the weft stopper provided such that the weft is arranged on the lower surface of the catch piece when the weft is stopped by the weft stopper after the weft, which has been introduced to the wedge-shaped gap, passes the distal tip of the tongue piece.

Preferably, the position of the weft stopper may be adjustable relative to the catch base in a longitudinal direction of the rapier head.

A head cover may be further provided at a side of the rapier head provided with the rear wall, the head cover extending in a longitudinal direction of the rapier head. The head cover may include an upper wall, and a rear side wall and a front side wall protruding downward from both sides of the upper wall. The rear side wall may have a weft guide that regulates the position of the weft when the weft is transferred to the carrier rapier. The front side wall may have an upper ridge gradually descending toward the distal side of the rapier head, and a distal tip connecting with the upper ridge. The upper ridge of the distal portion of the tongue piece may continuously extend to the upper ridge of the head cover in the side view of the rapier head in a state in which the tongue piece is located at the standby position. The upper wall, the front side wall, the upper ridge of the distal portion of the tongue piece, and an upper ridge of the rear wall may continuously extend to a distal portion of the rapier head.

The tongue piece may be arranged between the head cover and the catch piece in a top view of the insert rapier. The lower ridge of the tongue piece may be separated from the upper ridge of the rear wall in the side view of the rapier head in a state in which the tongue piece has been moved to the retracted position, and the lower ridge of the tongue piece, the upper ridge of the rear wall, and an upper ridge of the font wall may define a weft path communicating with the weft-holding portion.

The rear wall of the rapier head may have a protrusion that protrudes toward the proximal side of the rapier head from a top of the rear wall, the protrusion having a lower ridgeline, which is directed toward the distal side, then toward the proximal side, and connects with the bottom portion of the rapier head, to form a recessed weft-contacting portion configured to contact the weft when the weft is transferred to the carrier rapier. A lower ridge of the head cover and the lower ridge of the tongue piece may not overlap with the protrusion of the rear wall in the side view of the rapier head in a state in which the tongue piece has been moved to the retracted position, and the lower ridge of the head cover, the lower ridge of the tongue piece, the protrusion of the rear wall, and the upper ridge of the front wall may define a weft path communicating with the weft-holding portion.

In a state in which the tongue piece is located at the standby position, the distal tip of the tongue piece may be located higher than the weft when the weft extending at a predetermined angle to a warp direction is relatively moved while being in contact with an upper ridge of the rear wall and an upper ridge of the front wall by traveling of the insert rapier.

The lever provided with the tongue piece may have a pressure receiving portion at an end of the lever, the pressure receiving portion protruding above the rapier head, the lever being urged by an urging member such that the distal portion of the tongue piece is recovered to the standby position. The insert rapier may be used for a rapier loom in which an opener cam is arranged on a travel path of the rapier head such that the opener cam can contact the pressure receiving portion. The tongue piece may be moved to the retracted position because the pressure receiving portion contacts the opener cam before the weft passes the distal tip of the tongue piece.

The rapier head may include a displaceable pressure receiving member, and a motion transmitting portion that moves the tongue piece in association with the displacement of the pressure receiving member. The tongue piece is urged by an urging member such that the tongue piece is recovered to the standby position. The insert rapier may be used for a rapier loom in which an opener cam is arranged on a travel path of the rapier head such that the opener cam can contact the pressure receiving portion. The pressure receiving member may contact the opener cam and is displaced before the weft passes the distal tip of the tongue piece, and the pressure receiving member may move the tongue piece to the retracted position through the motion transmitting portion.

The tongue piece may be provided at a distal end of a slide lever extending in a longitudinal direction and supported movably in the longitudinal direction.

The rapier head may include a displaceable pressure receiving member, and a motion transmitting portion that associates with the displacement of the pressure receiving member. The tongue piece may be urged by an urging member such that the tongue piece is recovered to the standby position. The insert rapier may be used for a rapier loom in which an opener cam is arranged on a travel path of the rapier head such that the opener cam can contact the pressure receiving portion. The pressure receiving member may contact the opener cam and may be displaced before the weft passes the distal tip, and the pressure receiving member may move the tongue piece to the retracted position through the motion transmitting portion.

With the aspect of the present invention, the insert rapier having the warp-dividing portion, which is defined by the rear and front walls provided at the distal side of the rapier head, and the tongue piece provided between the rear and front walls, can attain the following advantages in addition to the advantage of reliably dividing the warps. When the weft is held, the tongue piece from among the front and rear walls and the tongue piece that define the warp-dividing portion is moved to the retracted position before the weft passes the distal tip of the tongue piece. Thus, the gap defined by the front and rear walls and the distal portion of the tongue piece (to be more specific, the distal tip of the tongue piece) is expanded, so as to guide the weft to the weft-holding portion. Accordingly, the weft that has been difficult to be introduced to the weft-holding portion, such as an entirely disconnected (easily separated) weft or a tape-like weft, can be reliably guided to the weft-holding portion without being hooked to the tongue piece. The weft less frequently fails to be caught; resulting in the productivity of woven fabric being increased.

The tongue piece is provided at the distal end of the lever that is rotatable in the up-down direction. Accordingly, the insert rapier having the simple configuration for displacing the tongue piece can be provided. Preferably, the weft-holding portion is configured to hold the weft between the catch base and the catch piece, and the catch piece is provided as a part of the lever that is rotatable in the up-down direction. Accordingly, when the weft is introduced to the weft-holding portion, the gap between the catch piece and the catch base can be expanded. The weft can be introduced to a deeper position in the weft-holding portion as compared with the related art. The weft can be entirely held by the weft-holding portion. Owing to this, the problem, in which the filaments may be broken or the weft may be split because stress is intensively exerted on part of the filaments of the weft when the weft is tucked into the narrow region in the gap of the weft-holding portion, can be addressed.

Preferably, the tongue piece is provided at the side of the catch piece. Accordingly, the configuration for moving the catch piece can be used for moving the tongue piece. The configuration can be simplified, and the catch piece can be moved simultaneously when the tongue piece is moved.

In the insert rapier in which the tongue piece is provided at the side of the catch piece, the lower ridge of the tongue piece continuously extends to the lower ridge of the catch piece in the side view of the rapier head. Accordingly, by traveling of the rapier head in the state in which the tongue piece is at the retracted position, the weft intersecting with the warps at the predetermined angle is guided while being in contact with the lower ridge of the tongue piece, and hence the weft can be reliably guided to the weft-holding portion.

In the insert rapier in which the tongue piece is provided at the side of the catch piece, the wedge-shaped gap is formed between the base surface of the catch base and the lower surface of the catch piece, which define the weft-holding portion, the wedge-shaped gap being open toward the distal side of the rapier head. When the tongue piece is moved to the retracted position during weft insertion, the lower surface of the catch piece can be separated from the base surface of the catch base. The weft can be introduced to the expanded wedge-shaped gap without stress being exerted on the weft. When the tongue piece is then moved to the standby position, the wedge-shaped gap is recovered to the normal gap. Accordingly, the introduced weft can be held by the wedge-shaped gap.

In the insert rapier in which the tongue piece is provided at the side of the catch piece, the weft stopper is further provided at the side of the catch base. The weft stopper determines the holding position of the weft in the wedge-shaped gap. When the weft, which has been introduced to the wedge-shaped gap, is stopped by the weft stopper, the weft is located on the lower surface of the catch piece. Accordingly, the weft can be prevented from entering the contact region of the weft-holding portion, the contact region being located at a deeper position than the wedge-shaped gap, from which the weft can be pulled out. The problem, in which the weft is not transferred to the carrier rapier because the weft cannot be pulled out, can be prevented from occurring. Preferably, the position of the weft stopper is adjustable in the longitudinal direction of the rapier head relative to the catch base and the catch piece, or relative to the wedge-shaped gap. Accordingly, the weft stopper can properly determine the holding position of the weft relative to the wedge-shaped gap, which is gradually narrowed in the longitudinal direction. The tucked state of the weft to the wedge-shaped gap (that is, the weft-holding force of the insert rapier) can be adjusted.

In the state in which the tongue piece is located at the standby position, in the side view of the rapier head, the upper ridge and the lower ridge of the rapier head are formed such that the projection shape of the rapier head at the distal side with respect to the weft-holding portion is tapered to converge at the distal portion of the rapier head. More specifically, the upper ridge of the distal portion of the tongue piece continuously extends to the upper ridge of the head cover. The upper wall of the head cover, the front side wall of the head cover, the upper ridge of the distal portion of the tongue piece, and the upper ridge of the rear wall continuously extend to the distal portion of the rapier head. Accordingly, when the insert rapier travels to be advanced into the shed of the warps, even if defectively shed warps because of entangled fluff is present, the warps guided by the position above the distal portion of the rapier head can be successively guided to the upper ridge of the rear wall, the upper ridge of the distal portion of the tongue piece, and the upper wall of the head cover. Thus, the defectively shed warps can be reliably divided.

Then, when the insert rapier holds the weft, before the weft is introduced, the lower ridge of the tongue piece is separated from the upper ridge of the rear wall in the side view of the rapier head in the state in which the tongue piece has been moved to the retracted position. The lower ridge of the tongue piece, the upper ridge of the rear wall, and the upper ridge of the front wall define the weft path communicating with the weft-holding portion. Accordingly, the weft that has been difficult to be introduced to the weft-holding portion by the insert rapier of the related art, such as an entirely disconnected (easily separated) weft or a tape-like weft, can be reliably guided to the weft-holding portion through the open weft path while the weft is still in the connected state. Thus, the weft can be further reliably held.

The rear wall of the rapier head has the recessed weft-contacting portion that is formed by the protrusion protruding toward the proximal side of the rapier head from the top of the rear wall and located between the top of the rear wall and the bottom portion. Accordingly, when the carrier rapier receives the weft from the insert rapier, the weft held by the weft-holding portion of the insert rapier is brought into contact with the weft-contacting portion so that the position of the weft is regulated, and the weft is pulled out. Hence, the weft can be pulled out of the weft-holding portion without excessive stress being exerted on the weft. Further, when the insert rapier holds the weft, the lower ridge of the head cover and the lower ridge of the tongue piece are separated from the protrusion of the weft-contacting portion in the side view of the rapier head in the state in which the tongue piece has been moved to the retracted position. In the side view of the rapier head, the lower ridge of the head cover, the lower ridge of the tongue piece, the protrusion of the weft-contacting portion, and the upper ridge of the front wall define the weft path that communicates with the weft-holding portion and is open in the advance direction. Also, the lower ridge of the tongue piece does not overlap with the protrusion in the region close to the protrusion of the rear wall. Accordingly, the weft path to the weft-holding portion can be expanded without an increase in the moving amount of the tongue piece. The weft can be reliably guided to and held by the weft-holding portion.

The distal tip of the distal portion of the tongue piece located at the standby position is located higher than the weft when the weft extending at the predetermined angle to the warp direction is relatively moved while being in contact with the upper ridge of the rear wall and the upper ridge of the front wall by traveling of the insert rapier. To insert the normal weft (connected weft), which has not caused a trouble during weaving in the past, the weft can be held in the existing manner although the tongue piece is not moved to the retracted position. To insert a disconnected weft or a weft having a special shape, which has caused a trouble during introduction of the weft to the weft-holding portion, the tongue piece is moved to the retracted position to expand the weft path. Thus, the weft can be reliably guided to the weft-holding portion. Therefore, whether the tongue piece is moved to the retracted position can be selected in accordance with the selected yarn kind. The number of driving operations to move the tongue piece can be decreased, and hence the life of the insert rapier can be increased.

The tongue piece is driven such that the opener cam provided on the travel path of the insert rapier is brought into contact with the pressure receiving portion provided at the end of the lever provided with the tongue piece. During traveling of the insert rapier, the tongue piece is moved to the retracted position before the distal tip of the insert rapier passes the weft. The insert rapier does not need a drive source, such as an actuator. The configuration can be simplified, and energy can be saved.

The tongue piece of the insert rapier is provided at the distal end of the slider lever extending in the longitudinal direction and supported movably in the longitudinal direction. During traveling of the insert rapier, the opener cam provided similarly to the above is brought into contact with the tongue piece, so that the tongue piece is moved from the standby position to the retracted position located at the proximal side in the longitudinal direction through the motion transmitting portion. Accordingly, the weft can be reliably guided to the weft-holding position similarly to the configuration in which the tongue piece is moved to the upper retracted position.

DESCRIPTION OF THE PREFERRED EMBODIMENTS

Figure 1:
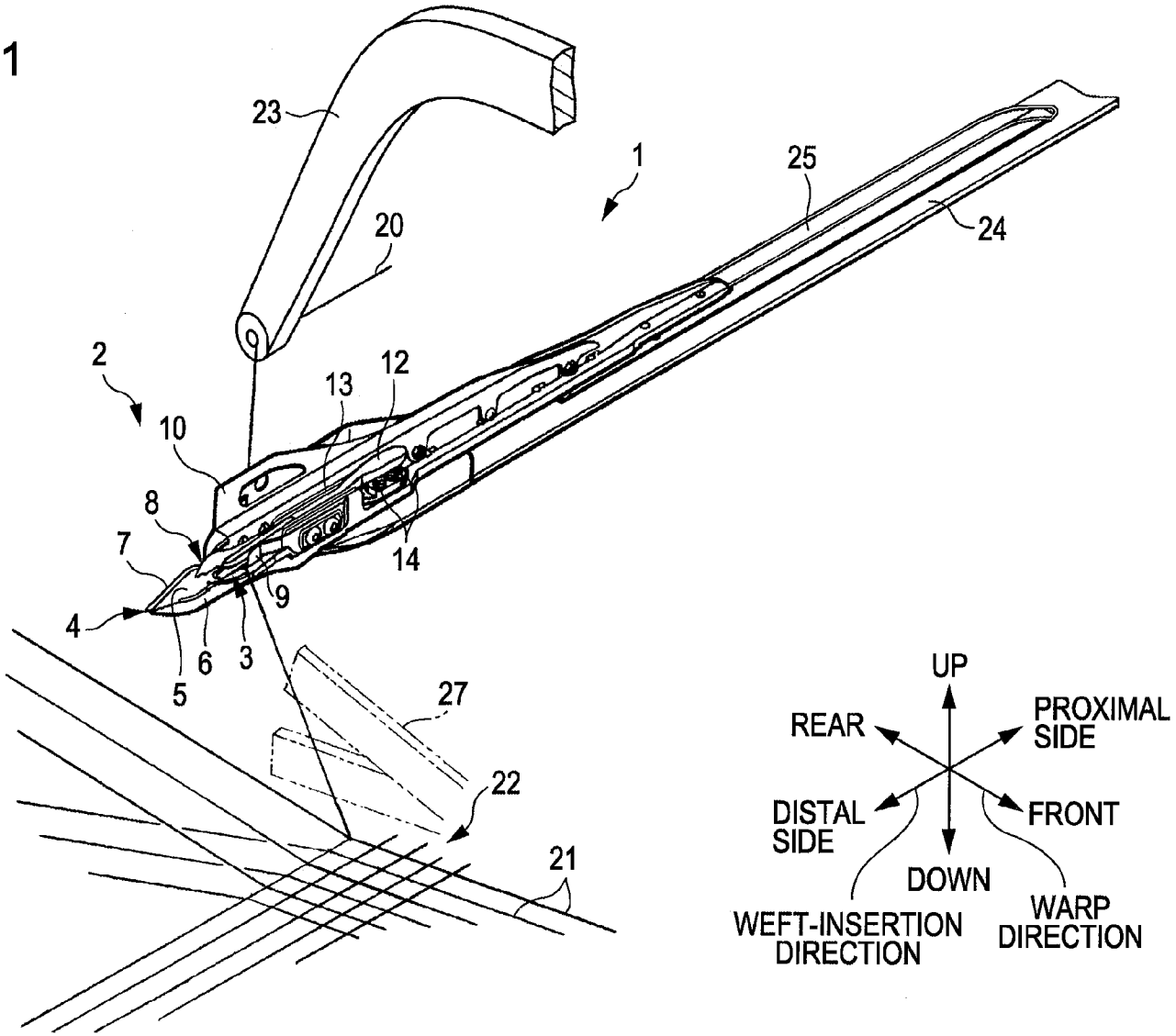
FIG. 1 is a general perspective view showing an insert rapier according to an embodiment of the present invention.

FIG. 1 illustrates an insert rapier according to an embodiment of the present invention. In this specification, the coordinate axes in FIG. 1 define the front, rear, distal, proximal, up, and down directions for the convenience of description. The wording "in a side view of a rapier head" means that the rapier head is viewed from the front to the rear of the illustrated coordinate axes.

An insert rapier 1 of this embodiment is used for a both-side rapier loom. The insert rapier 1 is provided at the weft-insertion side. Briefly describing the operation of the insert rapier 1, when the insert rapier 1 starts traveling in the weft-insertion direction, the insert rapier 1 causes a weft-holding portion 3 to hold a weft 20 which extends in the region between a woven fabric 22 and a weft selection lever 23 and connects with a weft feeder (not shown). The weft 20 is cut at a position between the insert rapier 1 and the woven fabric 22 because a yarn cutter 27 is actuated, substantially simultaneously when the weft 20 is held by the insert rapier 1. The insert rapier 1 travels in the shed formed of warps 21 while the insert rapier 1 holds the weft 20. The insert rapier 1 transfers the weft 20 to a carrier rapier (not shown) at substantially the center position of the weaving-width. Actually, a plurality of wefts 20 and a plurality of weft selection levers 23 are provided in accordance with a plurality of weft feeders for multi-color weft insertion. The distal tips of the wefts connect with the distal end of the woven fabric 22. In this specification, members relating to only one of the plurality of wefts are representatively illustrated for the convenience of description. The weft selection lever 23 changes the position of the selected weft in the up-down direction, the selected weft corresponding to a yarn-kind selection signal. Before the insert rapier 1 starts traveling, the weft selection lever 23 corresponding to the selected yarn kind is moved downward to be located at the position at which the insert rapier 1 can hold only the selected weft.

The entire structure of the insert rapier 1 will be briefly described below with reference to FIG. 2. The insert rapier 1 mainly includes a rapier band 24 that reciprocates the insert rapier 1, a rapier head 2 attached to the distal end of the rapier band 24 by an attachment jig 25, a tongue piece 8 attached to the rapier head 2, a head cover 10, and a head chip 26. The proximal end of the insert rapier 1 is attached to the upper surface of the distal portion of the rapier band 24 by the attachment jig 25. The head chip 26 is joined to the lower surface of the rapier head 2 by a plurality of screws (not shown). The head chip 26 and the rapier band 24 are members that slide on a slay of a loom body (not shown) or a plurality of GR guides during reciprocation of the insert rapier 1. The head chip 26 and the rapier band 24 are made of a material with a low friction resistance.

The rapier head 2 is a member serving as a main body of the insert rapier 1. The rapier head 2 has a bottom portion 5 at the distal side of the rapier head 2. The bottom portion 5 has a plate-like shape extending in the width direction (the warp direction) and toward the distal side (in the weft-insertion direction). The distal tip of the bottom portion 5 is sharpened in the weft-insertion direction. The bottom portion 5 has a cross groove 5*a* with a bottom at a position at the proximal side with respect to a distal portion 4 of the bottom portion 5. The cross groove 5*a* can receive a catch base 3*a* and a weft stopper 9 (a front stopper 9*a* and a rear stopper 9*b*), which will be described later. A proximal portion 5*e* of the rapier head 2 is fixed to the rapier band 24 by the attachment jig 25.

Figure 2:
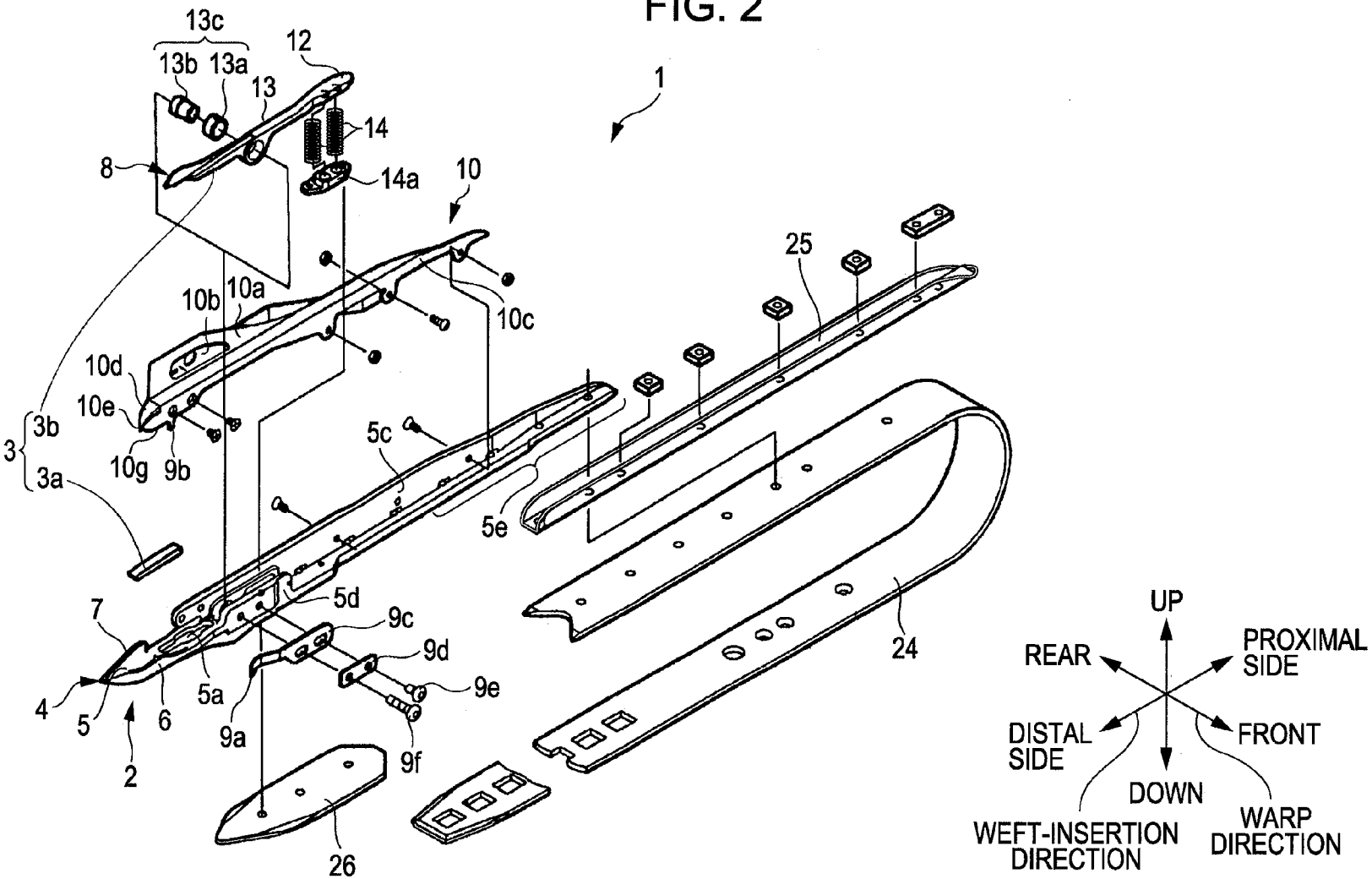
FIG. 2 is an exploded perspective view showing the insert rapier in FIG. 1.
Figure 3:
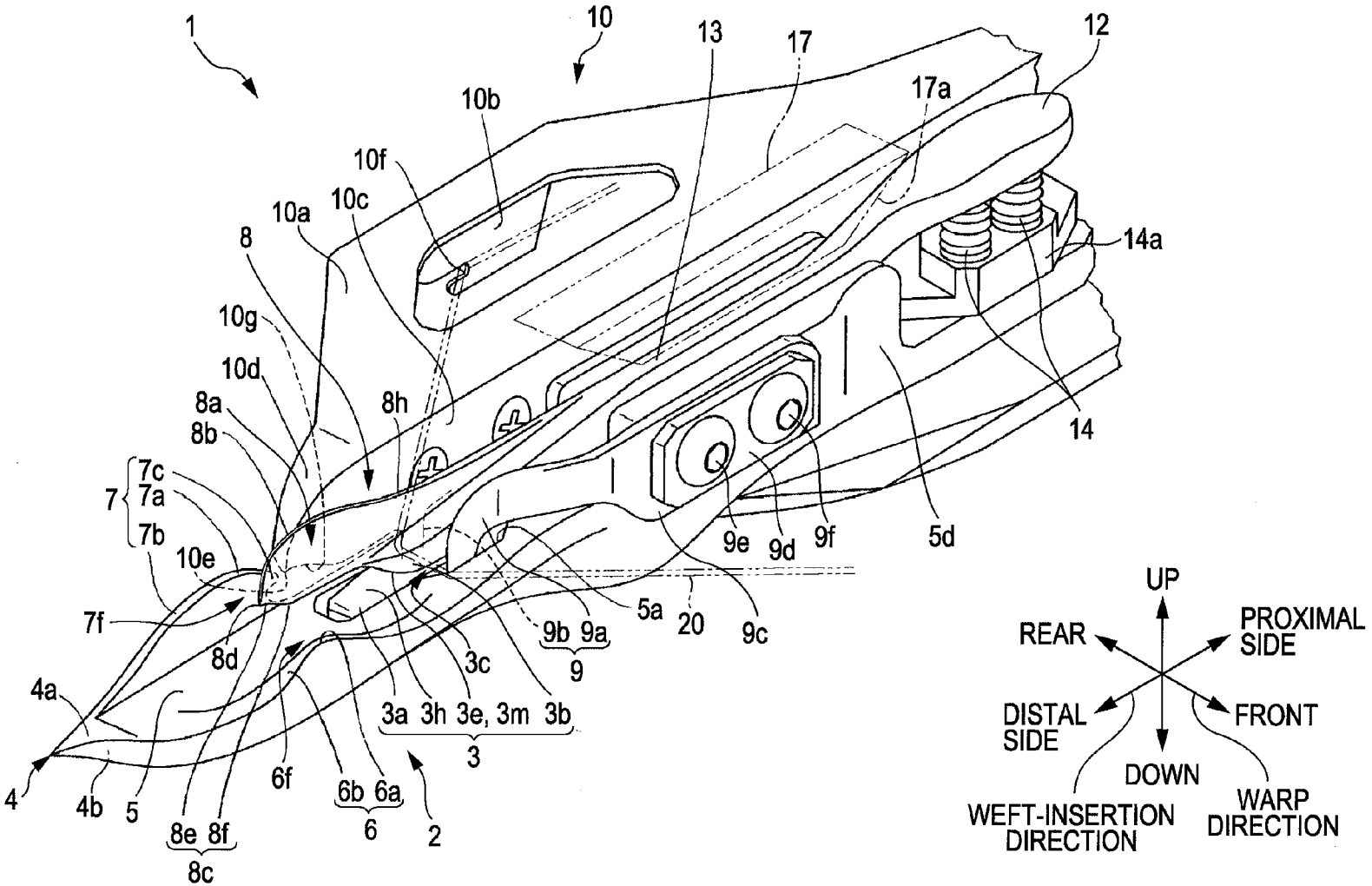
FIG. 3 is an enlarged perspective view showing a rapier head of the insert rapier in FIG. 1.
Figure 4:
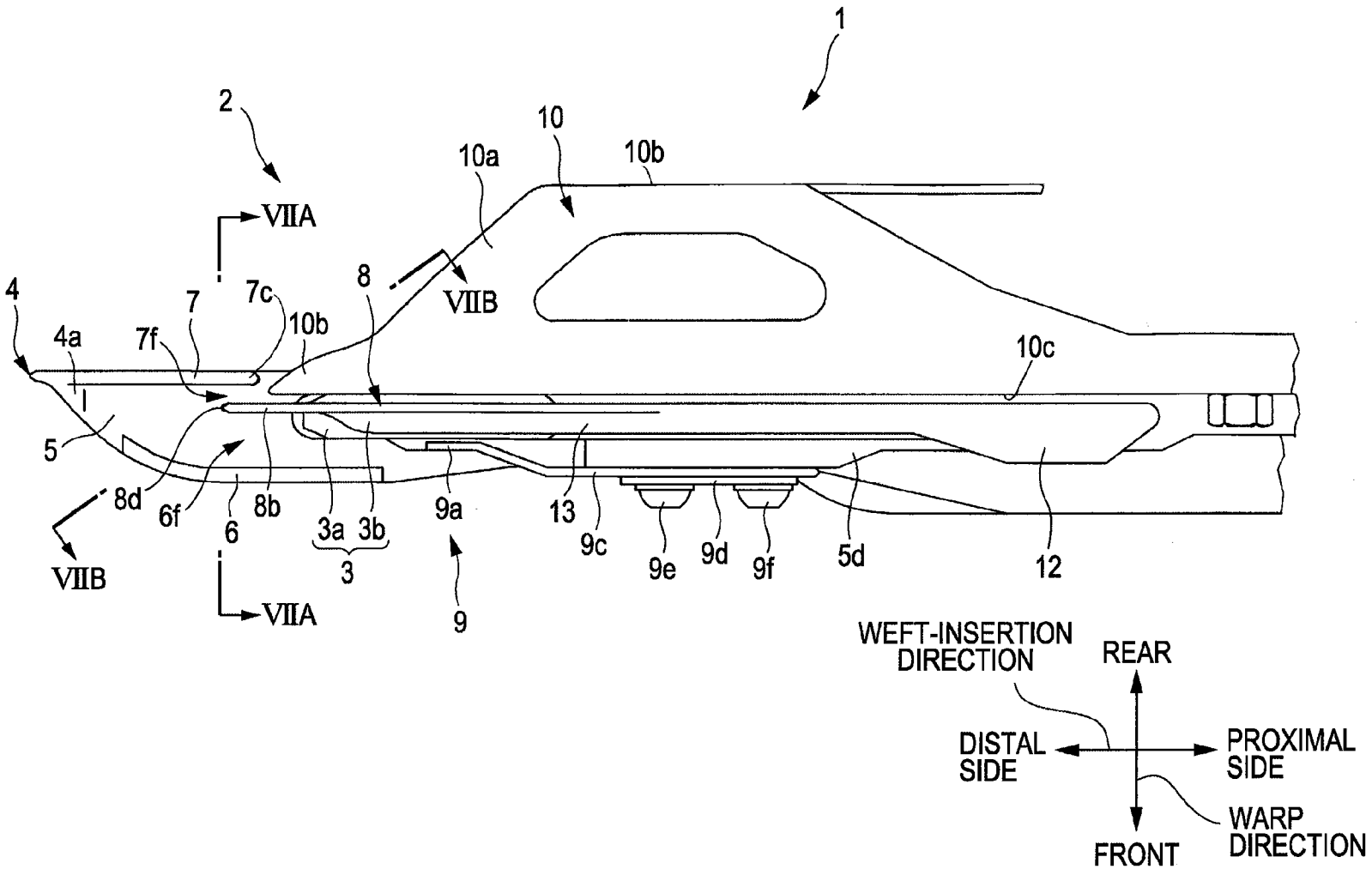
FIG. 4 is an enlarged plan view showing the rapier head of the insert rapier in FIG. 1.
Figure 5:
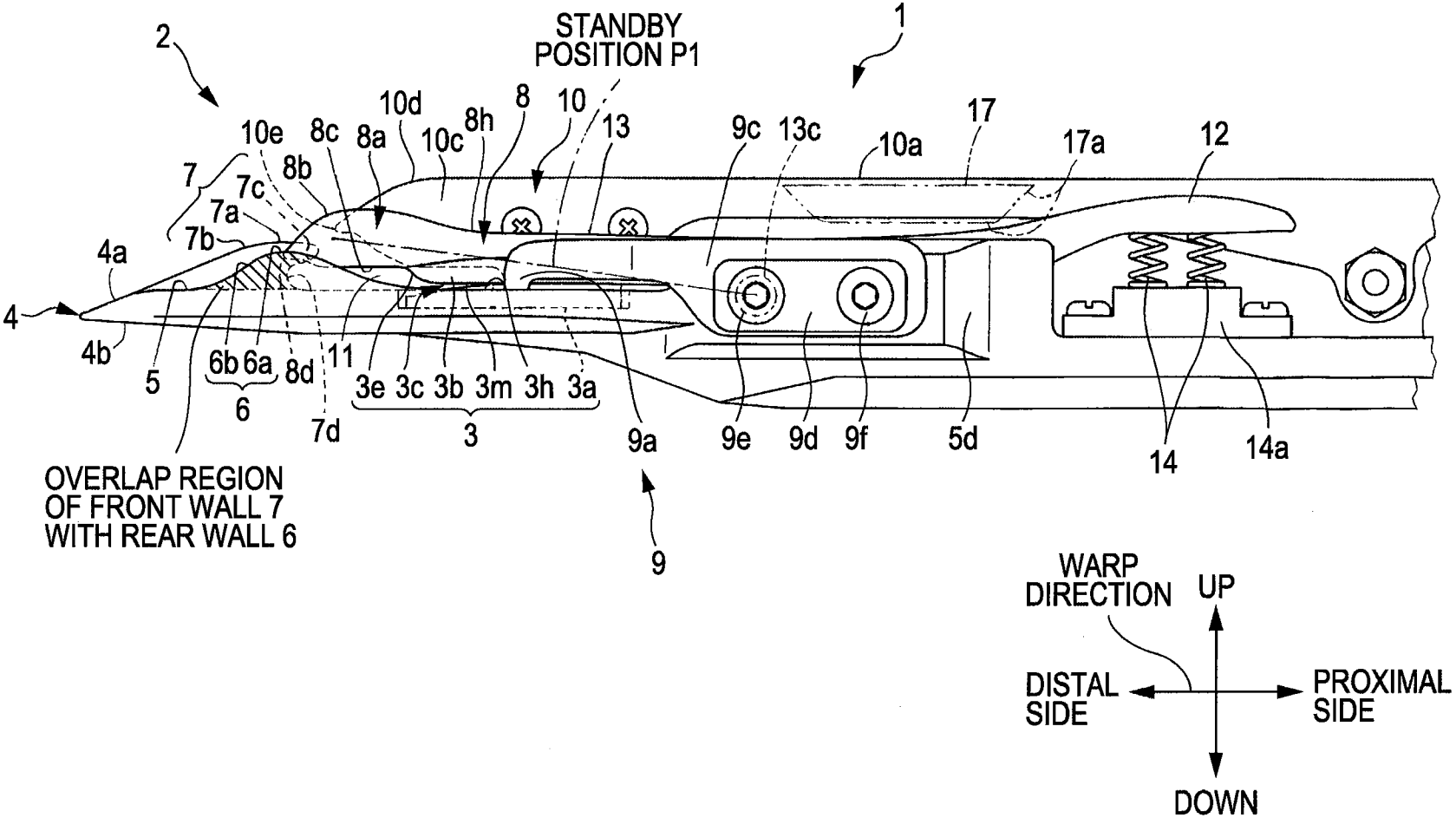
FIG. 5 is an enlarged side view showing the rapier head of the insert rapier in FIG. 1 when a tongue piece is located at a standby position.

FIGS. 3 to 5 illustrate the detail of the distal portion of the rapier head 2. The rapier head 2 has rear and front walls 7 and 6 at the distal portion of the rapier head 2. The front and rear walls 6 and 7 protrude upward from both sides in the width direction (in the front-rear direction in the figure) of the bottom portion 5 of the rapier head 2, and have hill-like or substantially hill-like shapes in the side view of the rapier head 2. The rear wall 7 has a shorter range for a proximal ridgeline. The front wall 6 has a region in which distal half portions of the front wall 6 and the rear wall 7 partly overlap with one another in the side view of the rapier head 2 (in a view from the cloth fell or the front in the figure, see FIG. 5). The front wall 6 and the rear wall 7 have ridgelines converging with the bottom portion 5 from tops 6*a* and 7*a* thereof toward the distal side. The start point of the ridgeline of the front wall 6 at the distal side of the rapier head 2 is located at the proximal side with respect to the start point of the ridgeline of the rear wall 7. The top 7*a* of the rear wall 7 is substantially aligned with the top 6*a* of the front wall 6. The ridgeline of the front wall 6 converges with the bottom portion 5 at a position at the proximal side with respect to the ridgeline of the rear wall 7 from the top 6*a* toward the distal side. These ridgelines define upper ridges 6*b* and 7*b* of the front and rear walls 6 and 7. The bottom portion 5 of the rapier head 2 is tapered to converge in the width direction and the thickness direction (in the up-down direction) toward the distal portion 4. The distal portion 4 has an upper guide portion 4*a* and a lower guide portion 4*b* serving as guide surfaces in the up-down direction. Referring to FIG. 2, the bottom portion 5 has wall portions 5*c* and 5*d* at the proximal side with respect to the cross groove 5*a*. The wall portions 5*c* and 5*d* serve as mounting eyes for receiving the head cover 10 and the weft stopper 9 (the front and rear stoppers 9*a* and 9*b*), and also serving as supporting walls for supporting a lever 13. The wall portions 5*c* and 5*d* extend upward from both sides in the front-rear direction in the figure of the bottom portion 5, and extend in the longitudinal direction for the aforementioned members to be joined thereto.

Referring to FIG. 5, the rear wall 7 of the rapier head 2 has a protrusion 7*c* extending from the top 7*a* of the rear wall 7 toward the proximal side of the rapier head 2. The protrusion 7*c* has an upper ridgeline connecting with the top 7*a* of the rear wall 7. The protrusion 7*c* has a lower ridgeline directed toward the distal side, then toward the proximal side, and connecting with the bottom portion 5 of the rapier head 2. The lower ridgeline serves as a hook-like weft-contacting portion 7*d* that contacts the weft 20 and regulates the position of the weft 20 when the weft 20 is transferred to the carrier rapier (not shown). The inner space defined by the weft-contacting portion 7*d* communicates with the space (a weft path 11 described later) formed between the bottom portion 5 and a catch piece 3*b* (described later).

Referring to FIG. 2, the head cover 10, which extends in the longitudinal direction of the rapier head 2, is provided at the rear wall portion 5*c* of the rapier head 2 such that a space is formed between the head cover 10 and the rear wall 7. The head cover 10, for example, formed by bending a plate member, includes an upper wall 10*a*, and a rear side wall 10*b* and a front side wall 10*c*, which extend downward from both sides in the width direction (in the front-rear direction in the figure) of the upper wall 10*a*.

Referring to FIG. 3, the upper wall 10*a* and the front side wall 10*c* of the head cover 10 have a distal tip 10*e* located lower than the upper wall 10*a*, at a position in the extension of the distal side of the front side wall 10*c*. The upper wall 10*a* and the front side wall 10*c* define an upper ridge 10*d* that gradually descends toward the distal side of the rapier head 2 and reaches the distal tip 10*e*. The front side wall 10*c* has a protrusion (the rear stopper 9*b*) and a lower ridge 10*g*. The protrusion extends downward and functions as the weft stopper 9 (described later). The lower ridge 10*g* continuously extends from the protrusion to the distal tip 10*e* in a curved manner.

The rear side wall 10*b* of the head cover 10 has a slit-like weft guide 10*f* opening toward the distal side. The weft guide 10*f* has a function of regulating the weft 20 so that the weft 20 does not move in the up-down direction during a period from when the insert rapier 1 holds the weft 20 until when the weft 20 is transferred to the carrier rapier (not shown). The weft guide 10*f* and the weft stopper 9 (particularly, the rear stopper 9*b*, described later) define a regulation portion that determines the holding position of the weft 20 at the weft-holding portion 3 (described later).

The weft-holding portion 3 is provided at the bottom portion 5, at the position between the rear wall 7 and the front wall 6 in the width direction (the front-rear direction) of the rapier head 2, the position being located between the front wall 6 and the front wall portion 5*d* in the longitudinal direction. The weft-holding portion 3 holds the weft 20 to be inserted. In this embodiment, the weft-holding portion 3 is defined by a base surface (an upper surface) 3*h* of the catch base 3*a* provided at the bottom portion 5 of the rapier head 2, and a lower surface (a facing surface) 3*m* of the catch piece 3*b* provided at the distal end of the lever 13 that is rotatable in the up-down direction.

The base surface 3*h* of the catch base 3*a* protrudes upward from the upper surface of the bottom portion 5, toward the proximal side while the catch base 3*a* is disposed in the cross groove 5*a* of the rapier head 2. The catch piece 3*b* is provided at the distal end of the lever 13. Referring to FIG. 2, the lever 13 is attached to the rapier head 2 rotatably in the up-down direction around a spindle member 13*c* (a bush 13*a*, a pin 13*b*) as the rotation shaft. The spindle member 13*c* penetrates through the rapier head 2 in the front-rear direction. Referring to FIG. 5, the catch piece 3*b* has the lower surface 3*m* serving as a facing surface facing the base surface 3*h* of the catch base 3*a*.

The lever 13 has a pressure receiving portion 12 at the end opposite to the catch piece 3*b* with respect to the spindle member 13*c*. The pressure receiving portion 12 protrudes above the rapier head 2. A helical compression spring 14 is provided on the lower surface of the pressure receiving portion 12. The helical compression spring 14 serves as an urging member. One end of the helical compression spring 14 is housed by a spring holder 14*a* in a properly compressed state. The other end of the helical compression spring 14 contacts the lower surface of the pressure receiving portion 12, and hence the helical compression spring 14 urges the pressure receiving portion 12 upward. Accordingly, the lower surface (the facing surface) 3*m* of the catch piece 3*b*, which is arranged opposite to the pressure receiving portion 12 with respect to the spindle member 13*c*, is partly elastically pressed to the base surface (the upper surface) 3*h* of the catch base 3*a*.

In this state, the part in which the base surface 3*h* of the catch base 3*a* contacts the lower surface 3*m* of the catch piece 3*b* is only a part located at the proximal side. The base surface 3*h* of the catch base 3*a* and the lower surface (the facing surface) 3*m* of the catch piece 3*b* define a wedge-shaped gap 3*c* that is open toward the distal side (the weft-insertion side) and holds the weft 20. The wedge-shaped gap 3*c* has a clearance that can hold the weft 20. The base surface 3*h* of the catch base 3*a* and the lower surface 3*m* of the catch piece 3*b* pinch the weft 20 to hold the weft 20.

The pressure receiving portion 12 of the lever 13 can contact an opener cam 17 provided on the travel path of the insert rapier 1 (the rapier head 2) of a loom body (not shown). To be more specific, the opener cam 17 has a lifting surface 17*a* protruding downward from the opener cam 17. The lifting surface 17*a* pushes the pressure receiving portion 12 by a predetermined section approximately when the distal portion 4 of the insert rapier 1 passes the weft 20. When the opener cam 17 contacts the pressure receiving portion 12 of the insert rapier 1 during traveling, the pressure receiving portion 12 is pushed down, and the catch piece 3*b*, which is located opposite to the pressure receiving portion 12 with respect to the spindle member 13*c*, is moved upward. Thus, the weft-holding portion 3 is opened.

FIG. 4 illustrates the insert rapier 1 shown in FIG. 3 in a top view. As shown in FIG. 4, the tongue piece 8 extends from a position closer to the weft-holding portion 3 than the rear wall 7 and the front wall 6, to the region between the rear wall 7 and the front wall 6. In this embodiment, the tongue piece 8 is located at the distal end of the lever 13, which is rotatable in the up-down direction. The tongue piece 8 is provided at the rear side of the catch piece 3*b* to be integrated with the catch piece 3*b*. The tongue piece 8 is arranged between the head cover 10 and the catch piece 3*b*. The tongue piece 8 has a distal tip 8*d* which is properly separated from the rear wall 7 and the front wall 6. Alternatively, the tongue piece 8 may be a member separated from the catch piece 3*b*, and the tongue piece 8 may be fixed to the catch piece 3*b* to be integrated with the catch piece 3*b*.

FIG. 5 illustrates the rapier head 2 in the state in which the catch base 3*a* and the catch piece 3*b* are pressed to one another (when the weft-holding portion 3 is closed) in the side view of the rapier head 2. In this state, the lifting surface 17*a* of the opener cam 17 does not contact the pressure receiving portion 12 of the lever 13.

The tongue piece 8 is integrated with the catch piece 3*b* as described above. Hence, the tongue piece 8 is moved with the catch piece 3*b*. The tongue piece 8 extends from the side of the catch piece 3*b* toward the distal side and in the up-down direction in a tongue-like manner. The tongue piece 8 has a distal portion 8*a* at the distal end thereof. In the state shown in FIG. 5 (when the weft-holding portion 3 is closed), the distal portion 8*a* of the tongue piece 8 has the distal tip 8*d* of the tongue piece 8 in the region in which the rear wall 7 and the front wall 6 overlap with one another in the side view of the insert rapier 1. In particular, the distal tip 8*d* of the tongue piece 8 is located at the position, which is at the distal side with respect to the distal tip 10*e* of the head cover 10, at the proximal side with respect to the distal portion 4 of the rapier head 2, located lower than the top 7*a* of the rear wall 7 and the top 6*a* of the front wall 6 in the height direction, and located higher than the upper surface of the bottom portion 5. In this specification, the state in which the distal tip 8*d* of the tongue piece 8 is located in the overlap region as shown in FIG. 5 represents that the tongue piece 8 is located at a "standby position P1." The same can be applied to the claims. The distal portion 8*a* of the tongue piece 8 is a part extending from an inflection point 8*h* at the proximal side of an upper ridge 8*b*, which protrudes upward, to the distal tip 8*d* of the tongue piece 8 (a part extending in a section S1 in FIG. 14). The same can be applied to the claims.

Referring to FIG. 5, the tongue piece 8 includes the upper ridge 8*b* and a lower ridge 8*c* continuously extending from the distal tip 8*d* of the tongue piece 8 toward the proximal side in a curved manner. The upper ridge 8*b* protrudes upward in the region from the side of the catch piece 3*b* to the distal tip 8*d* of the tongue piece 8. The lower ridge 8*c* continuously extends from the distal tip 8*d* of the tongue piece 8 toward the lower surface 3*m* (a lower ridge 3*e*) of the catch piece 3*b*. The upper ridge 8*b* of the tongue piece 8 extends between the upper ridge 7*b* of the rear wall 7 and the upper ridge 10*d* of the head cover 10 in the state in which the catch piece 3*b* is located at the standby position P1 (in the state shown in FIG. 5). The upper ridge 8*b* gradually ascends in the height direction (upward) toward the proximal side in the region across the two positions between which the tongue piece 8 extends. The upper ridge 8*b* serves as a guide surface of a warp-dividing portion (described later).

Figure 6:
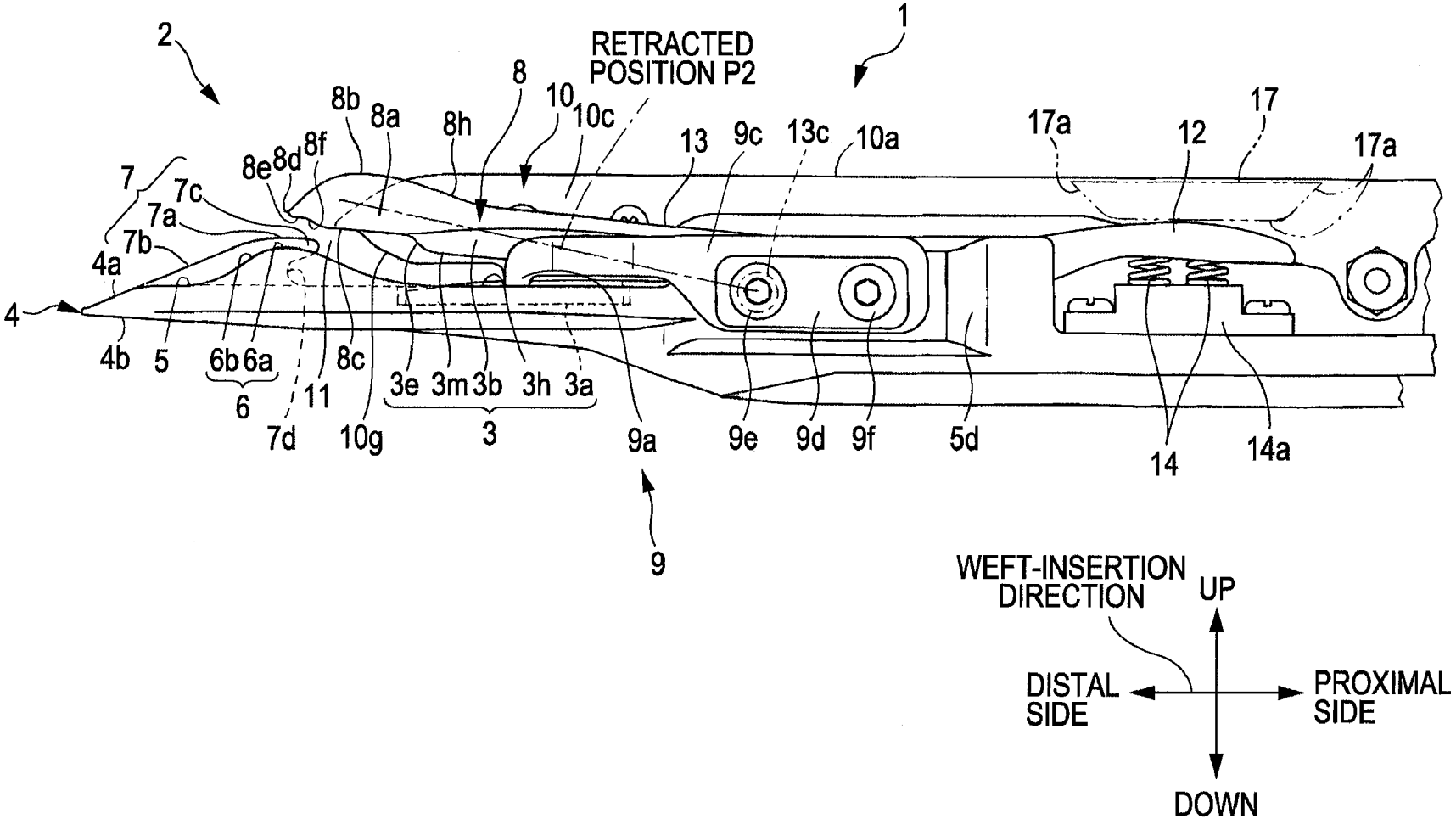
FIG. 6 is an enlarged side view showing the rapier head of the insert rapier in FIG. 1 when the tongue piece is located at a retracted position.

FIG. 6 illustrates the rapier head 2 when the weft-holding portion 3 is opened in the side view of the rapier head 2. When the lifting surface 17*a* of the opener cam 17 contacts the pressure receiving portion 12 and the pressure receiving portion 12 is pushed down by traveling of the insert rapier 1, the catch piece 3*b*, which is located opposite to the pressure receiving portion 12 with respect to the spindle member 13*c*, is moved upward. Thus, the weft-holding portion 3 is opened. At this time, the wedge-shaped gap 3*c* defined by the base surface (the upper surface) 3*h* of the catch base 3*a* and the lower surface (the facing surface) 3*m* of the catch piece 3*b* is expanded because the catch piece 3*b* is separated from the catch base 3*a*.

Also, the tongue piece 8 being integrated with the catch piece 3*b* is also moved upward simultaneously when the catch piece 3*b* is moved upward. In the state in which the tongue piece 8 has been moved upward, in the side view of the rapier head 2, the distal tip 8*d* of the tongue piece 8 is located above the top 7*a* of the rear wall 7 of the rapier head 2, whereas the lower ridge 8*c* of the tongue piece 8 is separated from the upper ridge 7*b* and the protrusion 7*c* of the rear wall 7. Consequently, the lower ridge 8*c* of the tongue piece 8, the upper ridge 7*b* and the protrusion 7*c* of the rear wall 7, the upper ridge 6*b* of the front wall 6, and the lower ridge 10*g* of the head cover 10 define a weft path 11. The weft path 11 is open in the advance direction of the insert rapier 1, or toward the distal side of the insert rapier 1, and communicates with the weft-holding portion 3. In this specification, as shown in FIG. 6, when the tongue piece 8 is located such that the weft path 11 is defined between the tongue piece 8 and the rear wall 7 because the lever 13 having the catch piece 3*b* is moved, the state represents that the tongue piece 8 is located at a "retracted position P2." The same can be applied to the claims.

FIGS. 5 and 6, and the subsequent figures each illustrate an auxiliary line by a dotted-chain line that connects the rotation center (the spindle member 13*c*) of the lever 13 with the center of the tongue piece 8, to show the relationship between the standby position P1 and the retracted position P2 of the tongue piece 8. Referring to FIG. 5, when the tongue piece 8 is located at the standby position P1, in the side view of the rapier head 2, the upper ridge 8*b* of the distal portion 8*a* of the tongue piece 8 extends between the upper ridge 7*b* of the rear wall 7 and the upper ridge 10*d* of the head cover 10. The upper ridge 8*b* gradually ascends from the distal tip 8*d* of the tongue piece 8 toward the proximal side of the insert rapier 1 in the region across the two positions between which the tongue piece 8 extends. The upper ridge 8*b* continuously extends to the upper wall 10*a* of the head cover 10. The upper wall 10*a* of the head cover 10, the front side wall 10*c* of the head cover 10, the upper ridge 8*b* of the distal portion 8*a* of the tongue piece 8, and the upper ridge 7*b* of the rear wall 7 continuously extend to the distal portion 4 (the upper guide portion 4*a*) of the rapier head 2, in the side view of the insert rapier 1. In other words, in the side view of the rapier head 2, the front wall 6, the rear wall 7, the tongue piece 8, and the head cover 10 have a tapered projection shape converging at the distal portion 4 of the rapier head 2, and define a warp-dividing portion.

Referring to FIG. 6, when the tongue piece 8 is located at the retracted position P2, the distal tip 8*d* of the tongue piece 8 is located above the top 7*a* of the rear wall 7 and the top 6*a* of the front wall 6 in the height direction. The lower ridge 8*c* of the tongue piece 8 continuously extends from the distal tip 8*d* to the lower surface 3*m* of the catch piece 3*b*. In the side view of the insert rapier 1, the lower ridge 8*c* of the tongue piece 8, the upper ridge 7*b* and the protrusion 7*c* of the rear wall 7, and the upper ridge 6*b* of the front wall 6 define the weft path 11 communicating with the wedge-shaped gap 3*c*.

FIG. 3 illustrates the state in which the insert rapier 1 has started traveling in the advance direction into the shed of warps but immediately before the insert rapier 1 contacts the opener cam 17. FIG. 3 imaginarily illustrates the weft 20 by a two-dot chain line to show the weft path when the weft 20 is held thereafter.

In FIG. 3, the weft stopper 9 (the front stopper 9*a*, the rear stopper 9*b*) is joined to the side of the catch base 3*a*. The weft stopper 9 determines the holding position of the weft 20 in the wedge-shaped gap 3*c*. In particular, the front stopper 9*a* is made of a plate member. The rear stopper 9*b* is integrated with the head cover 10. The front stopper 9*a* and the rear stopper 9*b* are joined to the rapier head 2 while protrusions thereof protruding downward are directed to the cross groove 5*a* in the bottom portion 5. An engagement piece 9*c* included in the weft stopper 9 and defining the front stopper 9*a* is fixed to the front wall portion 5*d* by a plate 9*d* and a plurality of screws 9*e* and 9*f*. The engagement piece 9*c* has a long hole extending in the longitudinal direction to allow the screws to extend therethrough. Thus, the position of the front stopper 9*a* can be adjusted relative to the catch base 3*a* in the longitudinal direction of the rapier head 2. The front stopper 9*a* is positioned at a desirable position in the longitudinal direction with respect to the wedge-shaped gap 3*c*, which is gradually narrowed toward the proximal side, so as to inhibit the weft 20 from being further advanced to a deeper position (toward the proximal side) than that position and to hold the weft 20. Accordingly, the weft-holding force of the weft-holding portion 3 can be increased and decreased.

To be more specific, referring to FIG. 3, the rear stopper 9*b*, which can engage with the weft 20, is provided close to the rear side portion of the catch base 3*a* such that the lower distal tip of the rear stopper 9*b* is housed in the cross groove 5*a*. By traveling of the rapier head 2, when the weft 20 extending at a predetermined angle to the warp direction contacts the rear stopper 9*b*, the weft 20 is located properly in the wedge-shaped gap 3*c* defined between the base surface 3*h* of the catch base 3*a* and the lower surface (the facing surface) 3*m* of the catch piece 3*b*. For example, the predetermined angle of the weft 20 to the warp direction ranges from 50° to 60°.

The front stopper 9*a* is provided at the front side portion of the catch base 3*a* within the region of the wedge-shaped gap 3*c* (the weft-holding portion 3) such that the lower distal tip of the front stopper 9*a* is housed in the cross groove 5*a*. The front stopper 9*a* determines the holding position of the weft 20 in the wedge-shaped gap 3*c* similarly to the rear stopper 9*b*.

As described above, the front stopper 9*a* of the weft stopper 9 is provided such that the position thereof can be relatively adjusted in the longitudinal direction of the rapier head 2 within the region of the wedge-shaped gap 3*c*. Accordingly, the holding position (weft-holding tension) of the weft 20 relative to the wedge-shaped gap 3*c* can be adjusted. Alternatively, the holding position of the rear stopper 9*b* may be adjustable. Still alternatively, both the holding position of the weft 20 and the holding position of the rear stopper 9*b* may be adjustable. Also, the front stopper 9*a* or the rear stopper 9*b* may be omitted.

To stably guide the weft 20 to the weft-holding portion 3, the width of the weft path 11 may be preferably constant or gradually decreased toward the proximal side, and the weft path 11 may preferably smoothly communicate with the weft-holding portion 3 from the opening portion thereof. For example, in the side view of the rapier head 2, the lower ridge 8*c* of the tongue piece 8 and the lower ridge 10*g* of the head cover 10 may preferably have a recessed projection shape that corresponds to a protruding projection shape of the front wall 6 and the rear wall 7.

Next, the weft insertion operation of the insert rapier 1 according to this embodiment will be described. Referring to FIG. 1, the weft 20 to be inserted extends tensely between the end of the woven fabric 22 and the weft selection lever 23 at a predetermined angle to the warps 21. The insert rapier 1, which travels in the weft-insertion direction, approaches the weft 20. Before the tensely extending weft 20 reaches the distal tip 8*d* of the tongue piece 8, the insert rapier 1 is brought into a state in which the pressure receiving portion 12 of the lever 13 is pressed by the opener cam 17 (not shown in FIG. 1) arranged on the moving path of the pressure receiving portion 12, and hence the weft-holding portion 3 is opened. In this state, the tongue piece 8 has been moved to the retracted position P2 (the state shown in FIG. 6).

The timing at which the weft-holding portion 3 is opened (at which the tongue piece 8 is moved to the retracted position P2) is desirably before the weft 20 passes the distal tip 8*d* of the tongue piece 8. However, the timing may be immediately before the weft 20 passes the distal tip 8*d* of the tongue piece 8.

By traveling of the insert rapier 1 in the weft-insertion direction, the tensely extending weft 20 contacts the distal portion 4 of the rapier head 2, and then the upper ridge 7*b* of the rear wall 7. The weft 20 is relatively moved toward the proximal side of the rapier head 2 while being in contact with the rear wall 7 by the tension of the weft 20. The weft 20 reaches the protrusion 7*c* of the rear wall 7 located at the most proximal side. At this timing, the tongue piece 8 has been moved to the retracted position P2. The distal tip 8*d* of the tongue piece 8 is located above the weft 20 which is in contact with the rear wall 7. Thus, the weft 20 passes the distal tip 8*d* without contacting the distal tip 8*d* because of the relative movement. The weft 20 which has passed the protrusion 7*c* falls toward the bottom portion 5 by the tension of the weft 20, and is introduced to the weft path 11.

The weft 20 introduced to the weft path 11 contacts the upper ridge 6*b* and the top 6*a* of the front wall 6 of the insert rapier 1, and is guided thereby. The weft 20 is further relatively moved. Thus, the weft 20 is guided by the lower ridge 8*c* of the tongue piece 8, the lower ridge 10*g* of the head cover 10, and the upper ridge 6*b* of the front wall 6. Then, the weft 20 is guided to the weft-holding portion 3. Simultaneously, the insert rapier 1 passes the opener cam 17, and the pressure exerted by the lifting surface 17*a* to the pressure receiving portion 12 is released. The lever 13 moves the tongue piece 8 from the retracted position P2 to the standby position P1 by the urging force with the helical compression spring 14. Accordingly, the weft-holding portion 3 is closed, and the gap defined between the lower surface 3*m* of the catch piece 3*b* and the base surface 3*h* of the catch base 3*a* is recovered to the normal gap. The weft 20 is stopped by the weft stopper 9 (the front stopper 9*a*, the rear stopper 9*b*) while being held by the weft-holding portion 3. At this time, the weft 20 is located on the lower surface (the facing surface) 3*m* of the catch piece 3*b* (at the position indicated by the imaginary line in FIG. 3). Thus, holding of the weft 20 is completed.

Then, the insert rapier 1 is further advanced into the shed of the warps 21 while drawing the weft 20 from the weft feeder (not shown). The insert rapier 1 travels to the center of the weaving-width (see FIG. 1). At this time, referring to FIG. 5, the tongue piece 8 is located at the standby position P1. In the side view of the rapier head 2, the front wall 6 and the rear wall 7 of the rapier head 2, the tongue piece 8, and the head cover 10 have a tapered projection shape converging at the distal portion 4 of the rapier head 2, and define a warp-dividing portion. The warp-dividing portion divides the defectively shed warps 21 into the upper and lower parts by the distal portion 4 (more particularly, including the upper guide portion 4*a* and the lower guide portion 4*b*) of the rapier head 2.

Figure 7A:
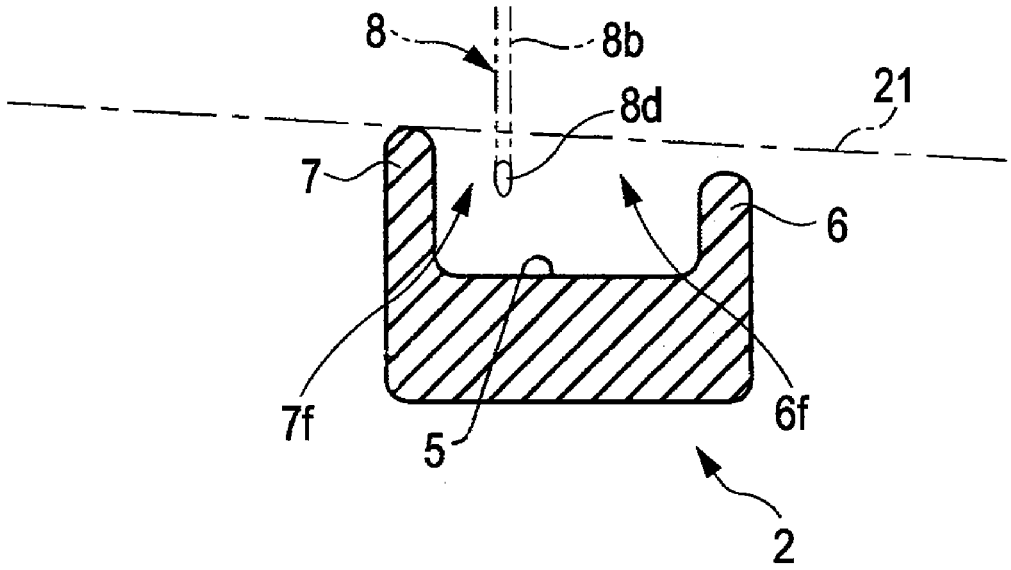
FIG. 7A is a cross-sectional view taken along line VIIA-VIIA in FIG. 4.

As described above, when the tongue piece 8 is located at the standby position P1, the distal tip 8*d* of the tongue piece 8 is located in the region in which the front wall 6 and the rear wall 7 overlap with one another in the side view of the rapier head 2. That is, when the rapier head 2 is shown in a view taken along a vertical plane (line VIIA-VIIA in FIG. 4) orthogonal to the weft-insertion direction, as shown in FIG. 7A, the distal tip 8*d* of the tongue piece 8 is located below the upper ridge 7*b* of the rear wall 7. Thus, even if the incompletely shed warps 21 due to entangled fluff or the like is present on the travel path of the insert rapier 1, the defectively shed warps 21 pass above the distal tip 8*d* of the tongue piece 8 and are tossed upward by the upper ridge 8*b* of the tongue piece 8. The warps 21 pass above the insert rapier 1 without entering the weft-holding portion 3. Accordingly, the defectively shed warps 21 are not hooked to the insert rapier 1 or incorrectly held by the weft-holding portion 3.

The weft 20, which has been carried by the insert rapier 1 to the center of the weaving-width, is transferred at that position to the carrier rapier (not shown), which has been inserted into the shed of warps 21 in the direction opposite to the weft-insertion direction (from the side opposite to the weft-feeding side). The carrier rapier, which has received the weft 20, is retracted in the weft-insertion direction, and carries the weft 20 to the end of the woven fabric 22 at the side opposite to the weft-insertion side. The insert rapier 1, which has transferred the weft 20 to the carrier rapier, is retracted in the direction opposite to the weft-insertion direction and is removed from the shed of warps 21. Thus, the weft insertion operation is completed. When the weft 20 is transferred from the insert rapier 1 to the carrier rapier, the weft 20 may be spontaneously pulled out of the wedge-shaped gap 3*c* of the weft-holding portion 3 because the carrier rapier is retracted, or the weft 20 may be released because the weft-holding portion 3 is opened during transferring.

As described above, with the insert rapier 1 of this embodiment, when the weft 20 is introduced into the weft-holding portion 3, the tongue piece 8 is moved to the retracted position P2, so that the opening can be sufficiently expanded to meet the diameter of the weft 20 and the wide weft path 11 can be defined. Accordingly, a failure hardly occurs when the weft 20 is guided to the weft-holding portion 3 as compared with the insert rapier of the related art. Even if the weft 20 is an entirely disconnected weft 20 or a weft having a special shape such as a flat cross-sectional shape, the weft 20 can be reliably guided to the wedge-shaped gap 3*c* defining the weft-holding portion 3, without being hooked to the tongue piece 8. Also, when the weft 20 is introduced to the weft-holding portion 3, the weft-holding portion 3 is opened, and the wedge-shaped gap 3*c* defined by the catch base 3*a* and the catch piece 3*b* is expanded, to introduce the weft 20 to the wedge-shaped gap 3*c*. Then, the wedge-shaped gap 3*c* is recovered to the normal wedge-shaped gap 3*c*. Even when the entirely disconnected weft 20 is used, the weft 20 can be collectively held without being separated in a plane. Accordingly, although a weft has tended to be split with the use of the insert rapier of the related art, with this embodiment, the weft 20 can be prevented from being split during traveling of the insert rapier. In addition, the monofilament of the weft 20 can be prevented from being broken or damaged as a result of bending stress being intensively exerted partly on the filament of the weft 20.

Figure 17:
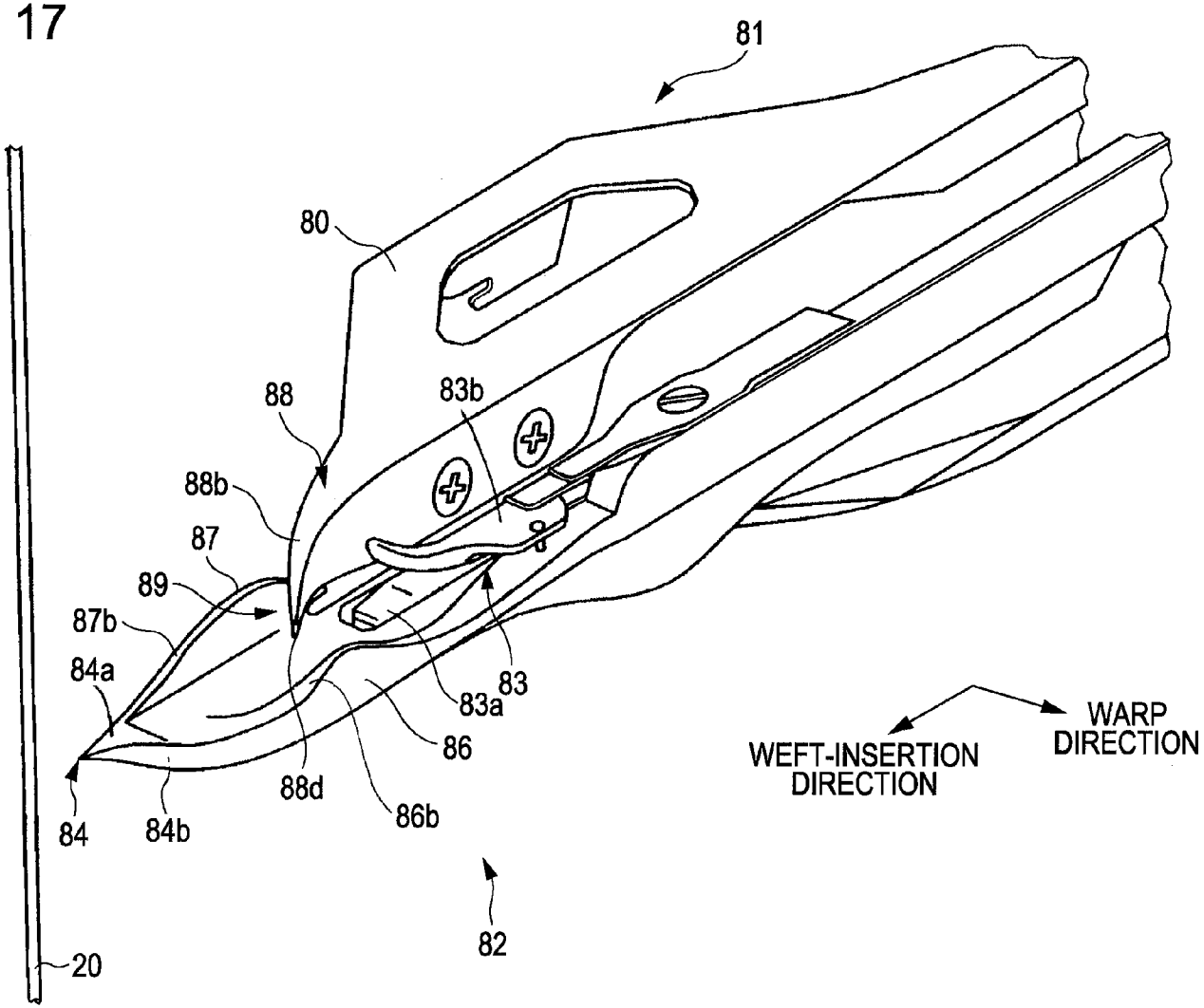
FIG. 17 is a perspective view showing the operation of the insert rapier in FIG. 16.
Figure 18:
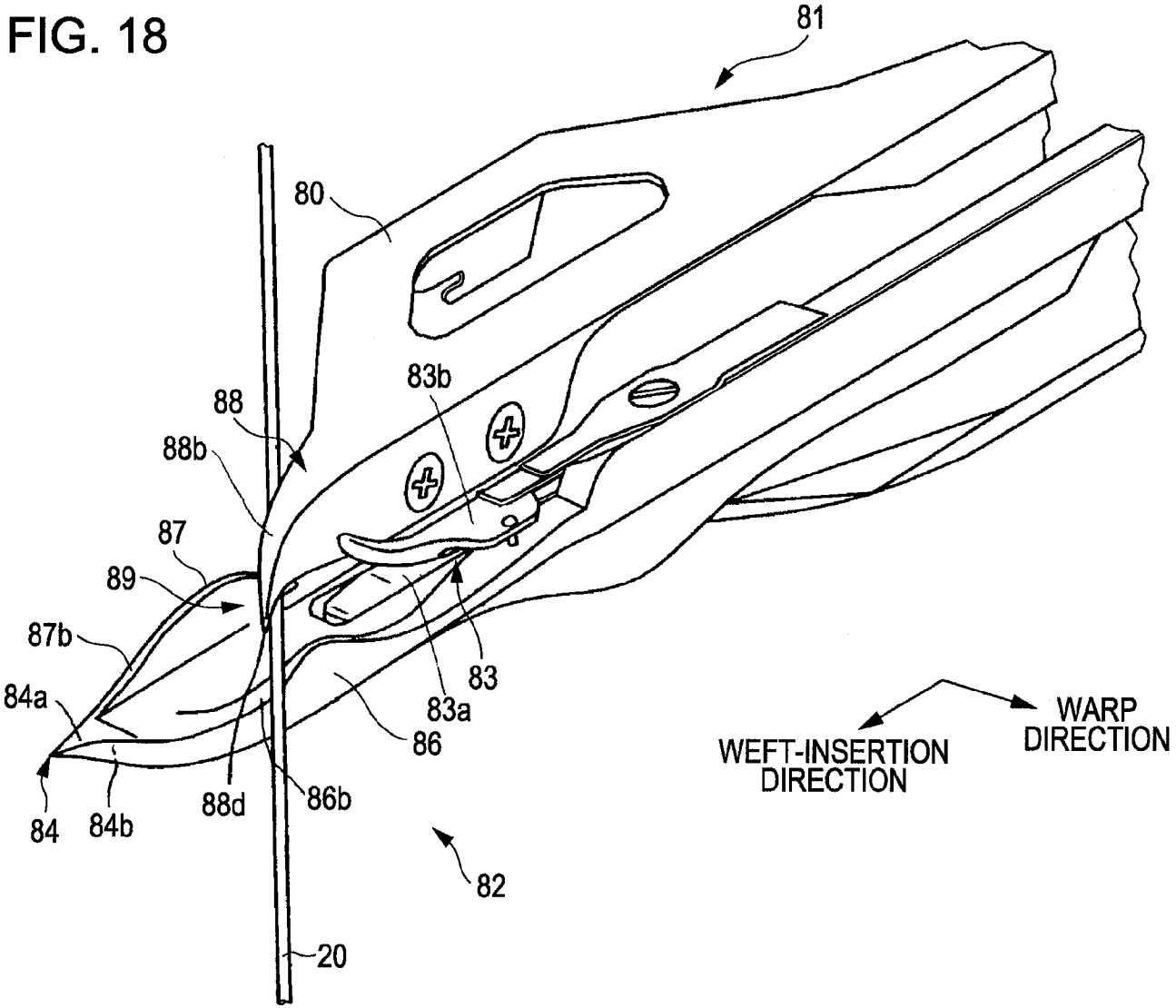
FIG. 18 is a perspective view showing the operation of the insert rapier in FIG. 16.
Figure 19:
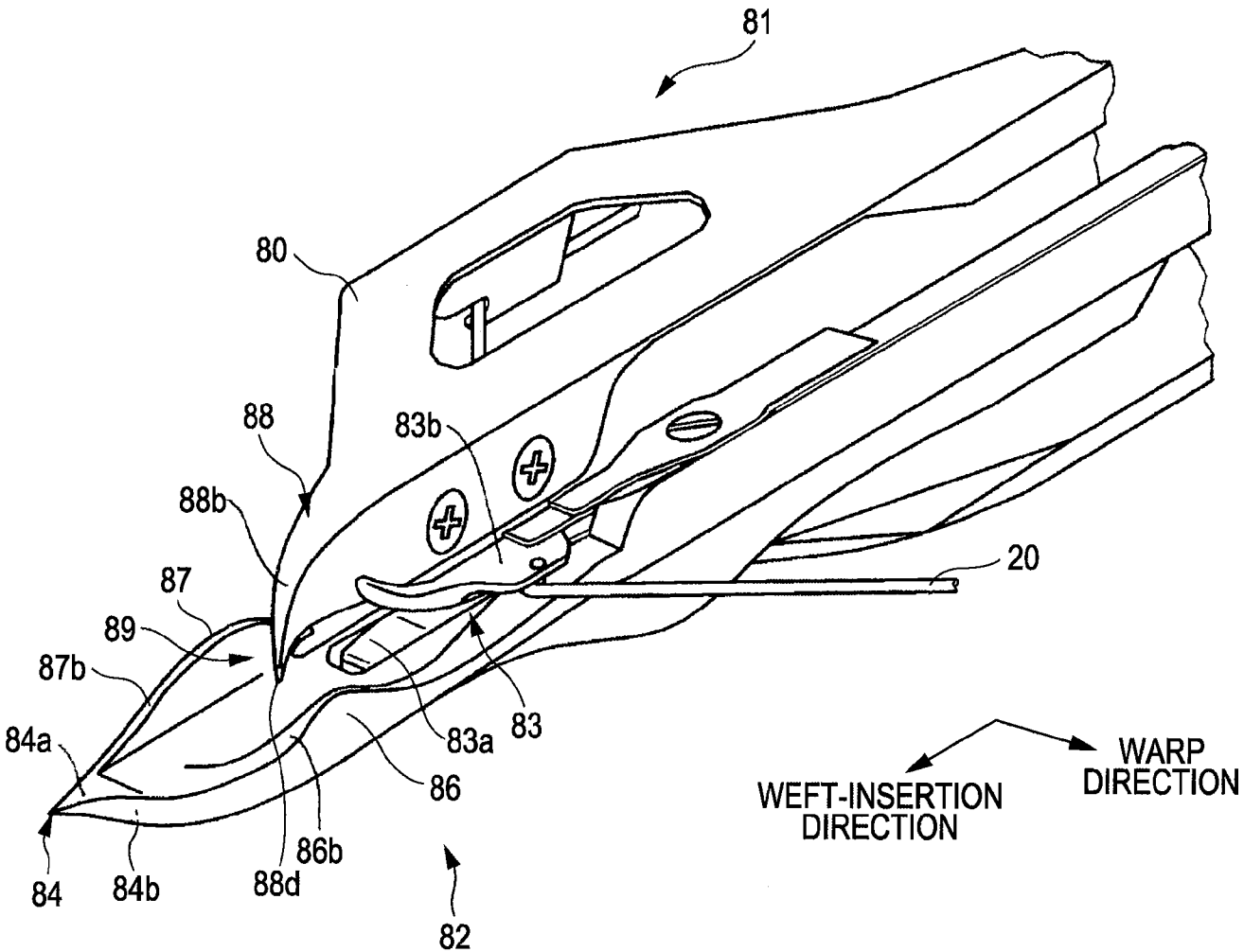
FIG. 19 is a perspective view showing the operation of the insert rapier in FIG. 16.
Figure 20:
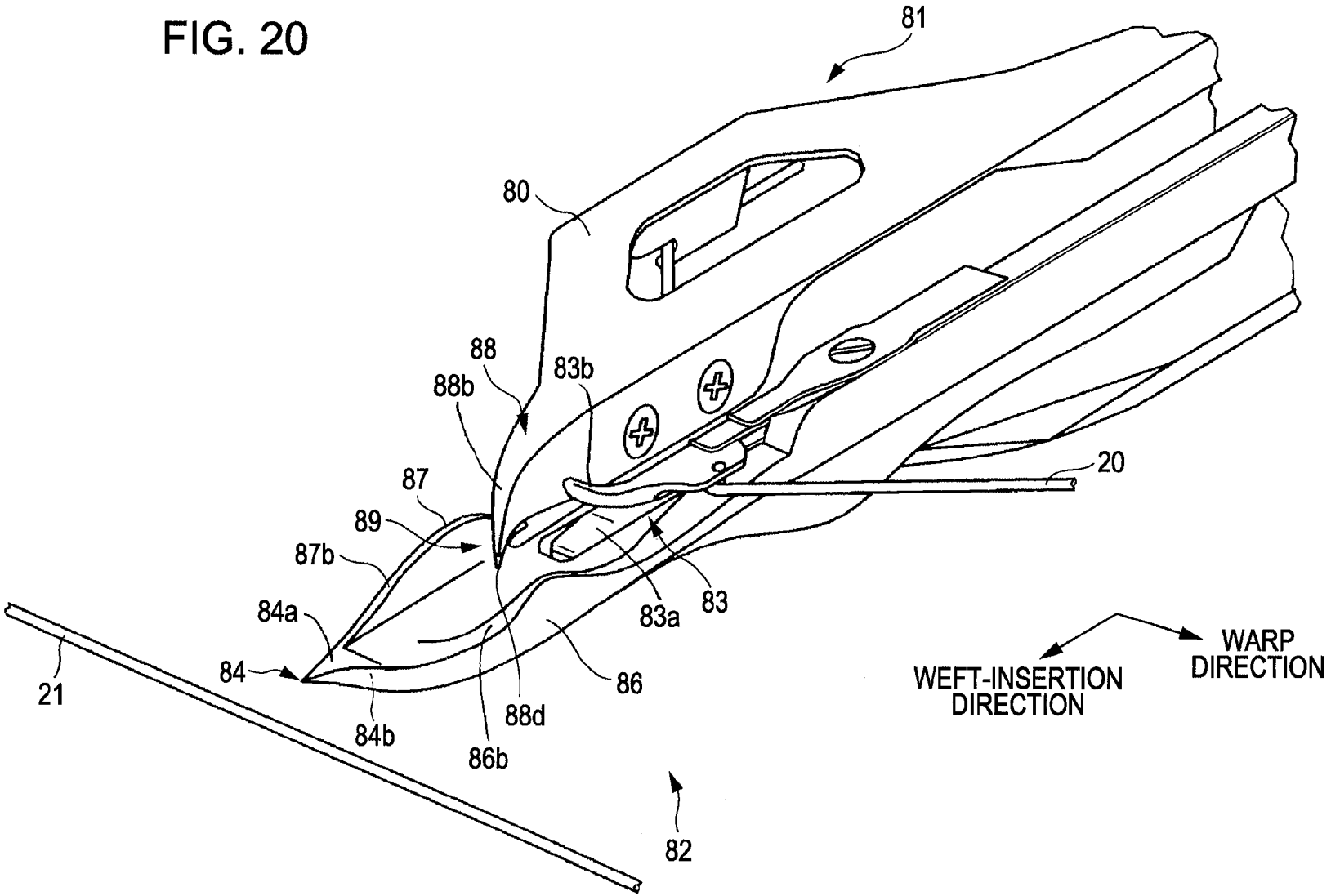
FIG. 20 is a perspective view showing the operation of the insert rapier in FIG. 16.
Figure 21:
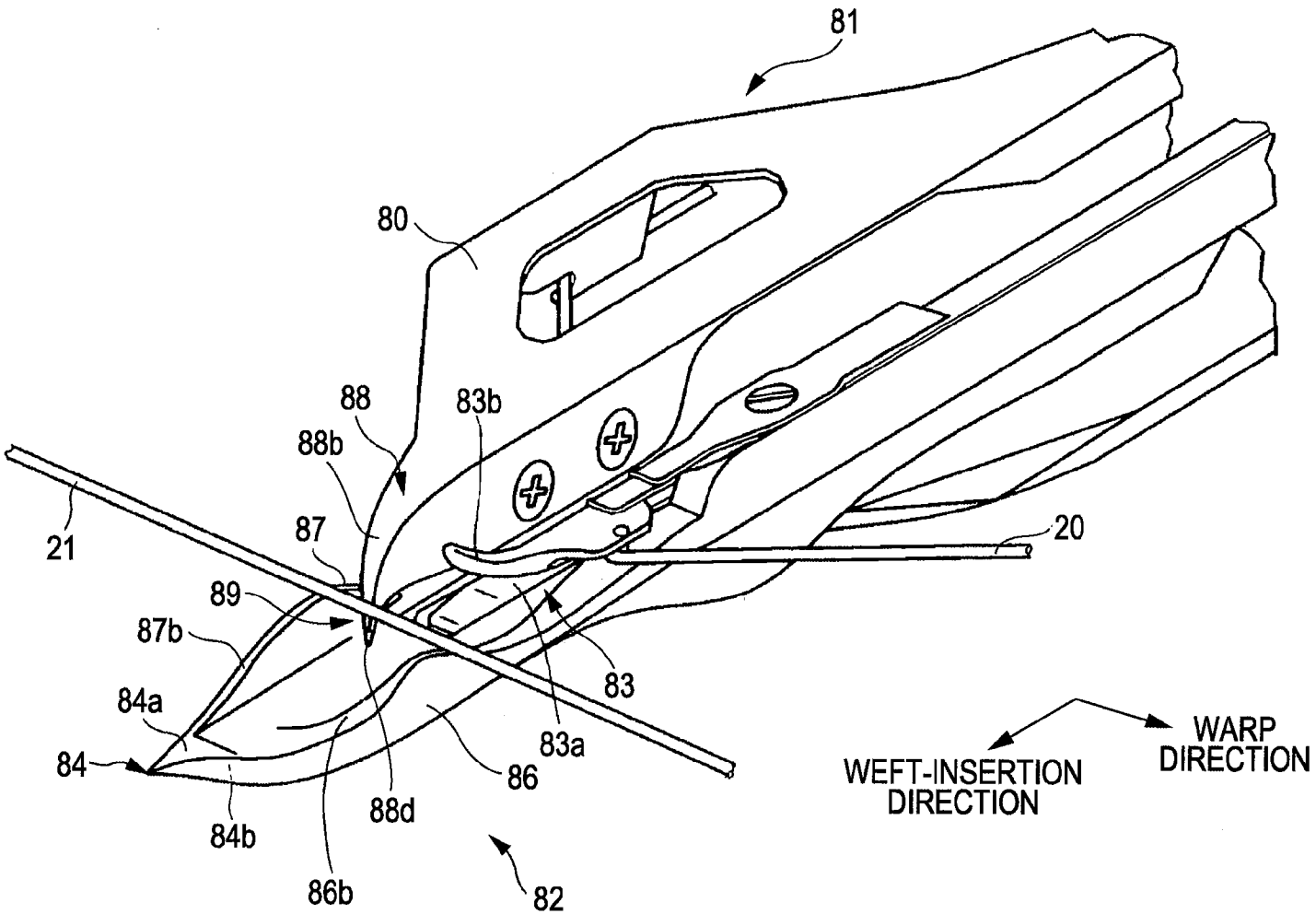
FIG. 21 is a perspective view showing the operation of the insert rapier in FIG. 16.
Figure 22:
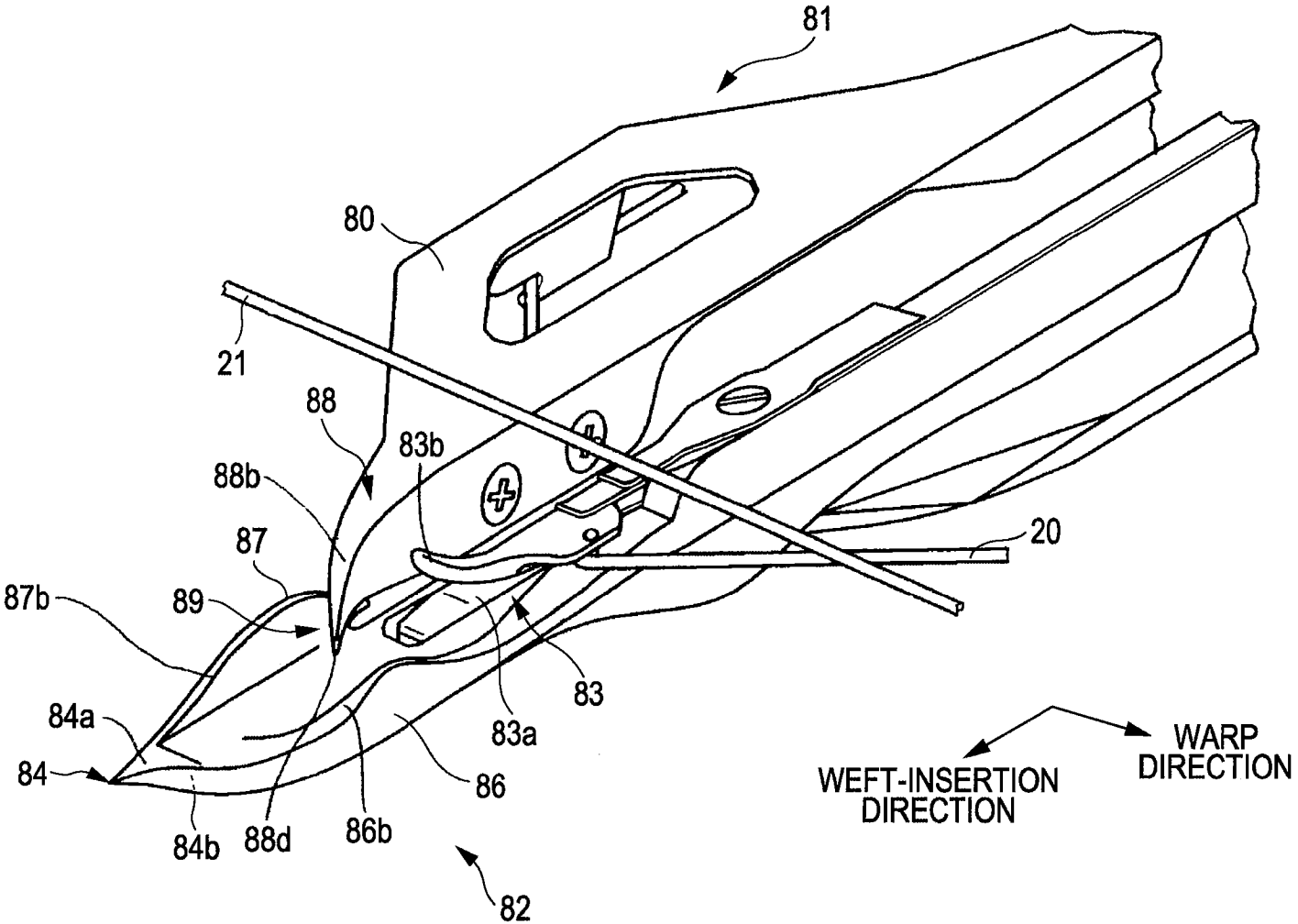
FIG. 22 is a perspective view showing the operation of the insert rapier in FIG. 16.

In the above description, to address the problem, i.e., to stably hold the disconnected weft 20, the tongue piece 8 is moved to the retracted position P2 and the weft-holding portion 3 is opened during weft insertion. However, in this embodiment, when a weft, which has been weavable in the past (an entirely connected weft), is inserted, the tongue piece 8 may not be moved, and the weft 20 may be tucked into and held by the weft-holding portion 3, for weft insertion. In this case, the insert rapier 1 of this embodiment does not perform the opening and closing operation for the tongue piece 8 and the weft-holding portion 3, like the insert rapier of the related art shown in FIGS. 17 to 19.

Figure 7B:
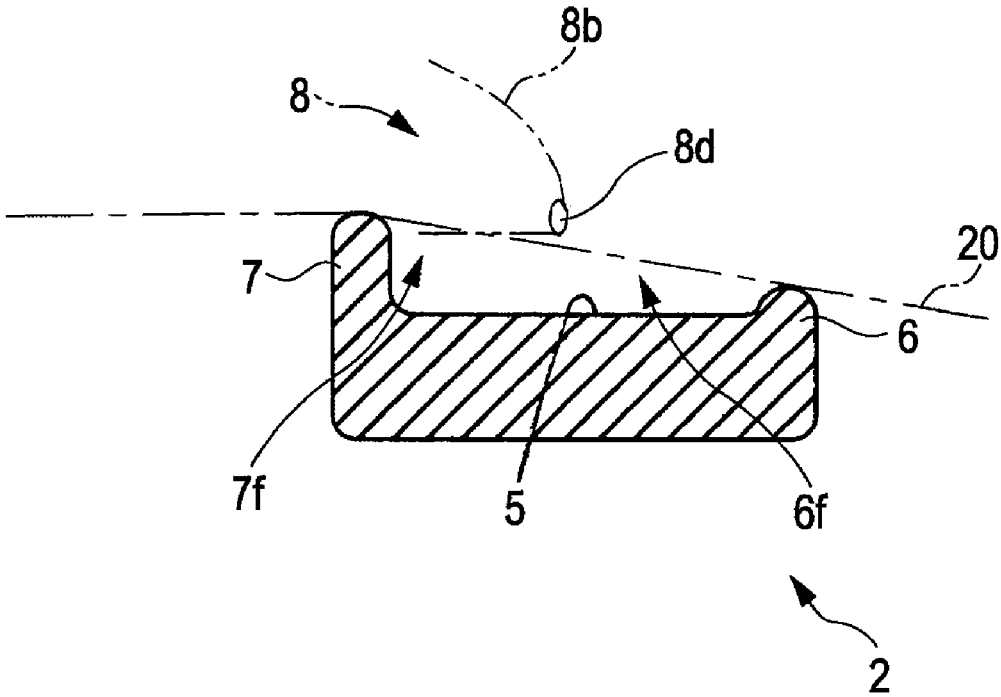
FIG. 7B is a cross-sectional view taken along line VIIB-VIIB in FIG. 4.

Here, briefly described just for reference is a method of holding a weft when the weft is inserted while the tongue piece 8 is not moved, and the weft-holding portion 3 is not opened or closed, according to this embodiment. Referring to FIG. 1, by traveling of the insert rapier 1 in which the tongue piece 8 (the weft-holding portion 3) is closed (in the state shown in FIG. 5), the weft 20 tensely extending to intersect with the warps 21 at a predetermined angle contacts the upper ridge 7*b* of the rear wall 7 of the rapier head 2. The weft 20 is relatively moved toward the proximal side of the rapier head 2 while being in contact with the rear wall 7 by the tension of the weft 20. Then, the weft 20 reaches the distal tip 8*d* of the tongue piece 8. At this time, when the rapier head 2 is shown in a view taken along a vertical plane (line VIIB-VIIB in FIG. 4) containing the weft 20, as shown in FIG. 7B, the shapes of the front wall 6, the rear wall 7, and the tongue piece 8 are determined such that the distal tip 8*d* of the tongue piece 8 is located above the weft 20 extending between the front wall 6 and the rear wall 7. Referring to FIG. 4, in a top view of the rapier head 2, the tongue piece 8 is properly separated from the rear wall 7 and the front wall 6 in the width direction of the rapier head 2. The tongue piece 8 defines gaps 7*f* and 6*f* with respect to the rear wall 7 and the front wall 6. The weft 20 can pass through the gaps 7*f* and 6*f*. Thus, the weft 20, which has passed the protrusion 7*c* of the rear wall 7, falls toward the bottom portion 5 by the tension of the weft 20, and enters the gap 7*f* between the rear wall 7 and the tongue piece 8 without contacting the distal tip 8*d* of the tongue piece 8. By the movement of the insert rapier 1, the weft 20 is moved from the gaps 7*f* and 6*f* through the space between the tongue piece 8 and the bottom portion 5 toward the proximal side of the rapier head 2. Then, the weft 20 is guided to the wedge-shaped gap 3*c* defining the weft-holding portion 3, and is held by the wedge-shaped gap 3*c*. As described above, with the insert rapier 1 of this embodiment, the weft, which has been weavable in the past, can be used. In addition, the entirely disconnected weft, which has been difficult in weaving in the past, can be used. Various kinds of fabrics can be woven.

Alternatively, the opening and closing operation of the tongue piece 8 and the weft-holding portion 3 may be performed in any case irrespective of the kind of yarn, even when the weft can be held without the tongue piece 8 being moved. In this case, the position of the tongue piece 8 is not particularly limited, that is, the tongue piece 8 does not have to be provided with a limitation in which a predetermined distance (the gap 7*f*) is provided between the tongue piece 8 and the rear wall 7. The tongue piece 8 may be located at any position as long as the tongue piece 8 is located at the rear lateral side of the catch piece 3*b* (at the side of the rear wall 7) and the tongue piece 8 does not interfere with the carrier rapier (more particularly, the tongue piece 8 may be provided inside the head cover 10).

Still alternatively, the opening and closing operation of the tongue piece 8 and the weft-holding portion 3 may be selectively performed depending on the kind of weft. For example, when the type of fabric is changed, and hence the kind of all wefts to be inserted is changed to the kind that is difficult to be held by the insert rapier of the related art, the opener cam 17 may be manually mounted on the travel path of the insert rapier 1 during setting of the loom. In contrast, when the kind of all wefts is changed to the kind that is easy to be held, the opener cam 17 may be manually removed. Thus, the insert rapier of this embodiment can be used. Yet alternatively, when the kind of yarns that is difficult to, be held by the insert rapier of the related art and the kind of yarns that is not are mixed, the kind of yarns to be inserted may be selected in accordance with the step number of weft insertion. Only when the weft that is difficult to be guided to the weft-holding portion 3 is selected by a weft selection signal, the opener cam 17 may be advanced to a position on the travel path of the insert rapier 1 by an electric actuator (not shown). When the weft that is easy to be guided is selected by a weft selection signal, the opener cam 17 may be retracted from the travel path. Accordingly, wearing of the lever 13 and the spindle member 13*c* can be reduced, and an impact to the insert rapier 1 can be reduced.

Figure 8A:
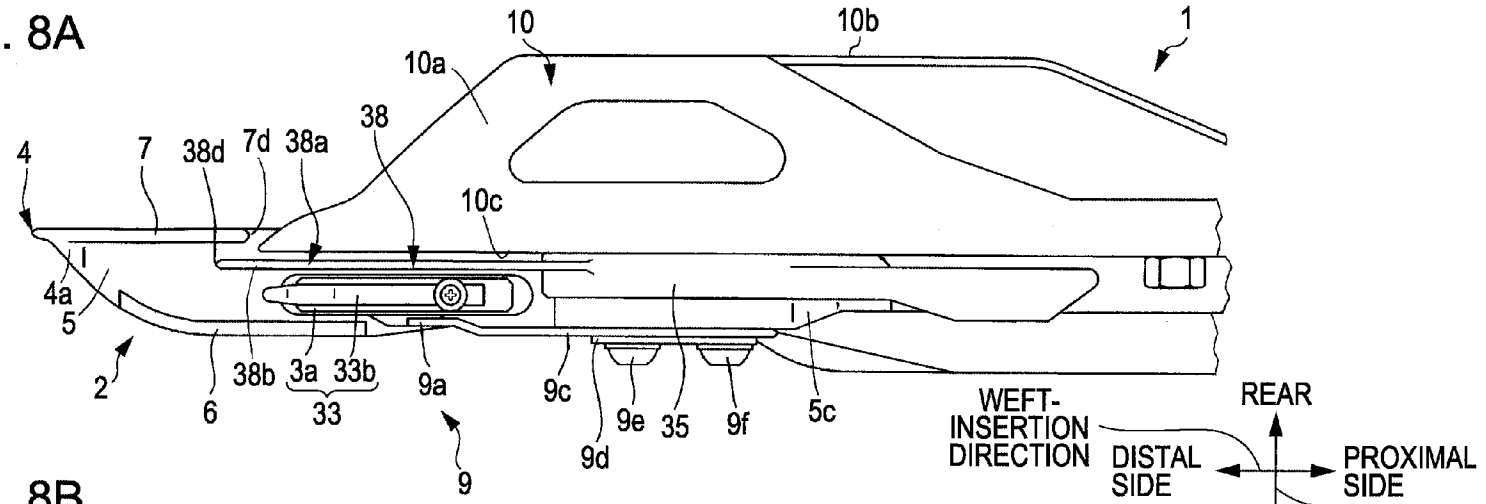
FIG. 8A is an enlarged plan view showing an insert rapier according to another embodiment of the present invention.
Figure 8B:
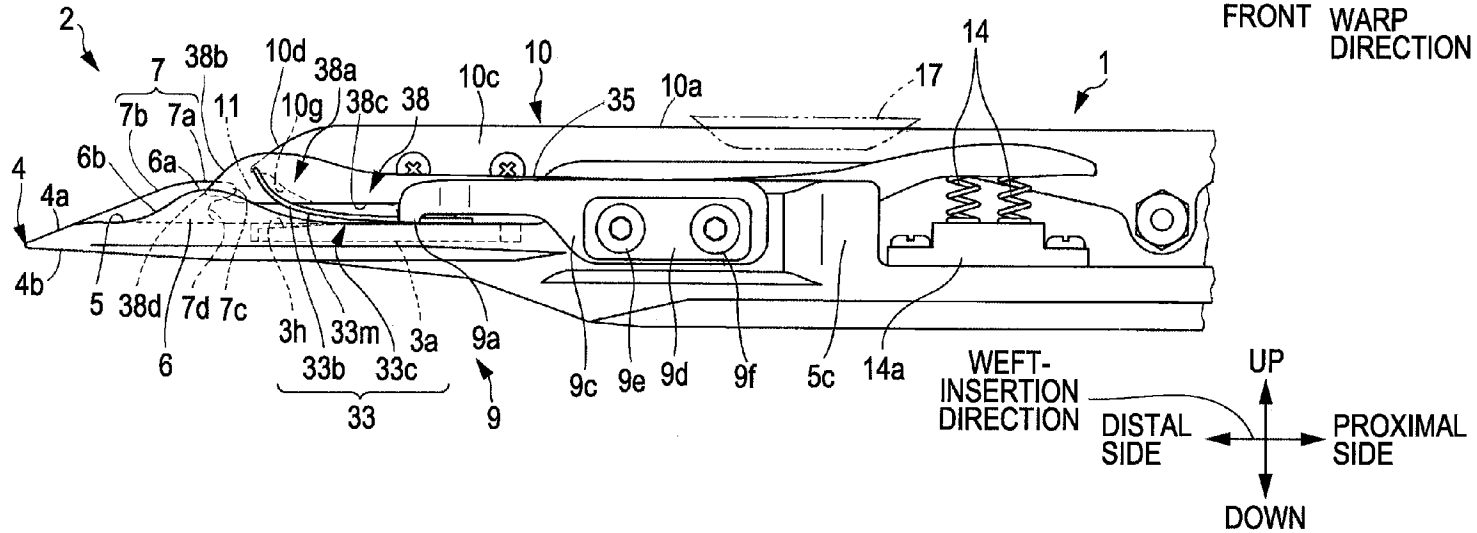
FIG. 8B is an enlarged side view showing the insert rapier in FIG. 8A.

An insert rapier according to other embodiments of the present invention is illustrated in FIGS. 8A and 8B, and the subsequent figures. FIGS. 8A and 8B each show another embodiment in which the weft-holding portion 3 is not opened or closed, and only a tongue piece 38 is movable. FIGS. 8A to 13 show other embodiments relating to a mechanism for moving the tongue piece 8.

In the embodiment shown in FIGS. 8A and 8B, a catch piece 33*b* is made of a plate member that is elastically deformable. The catch piece 33*b* is fixed to the bottom portion 5 of the rapier head 2 by a screw (not shown) such that a lower surface 33*m* of the catch piece 33*b* faces the base surface 3*h* of the catch base 3*a*. The tongue piece 38 is solely moved by a lever 35 having the tongue piece 38 at the distal end thereof. The tongue piece 38 in this embodiment has a shape substantially similar to the tongue piece 8 shown in FIGS. 2 to 6. The tongue piece 38 shown in FIGS. 8A and 8B has a distal portion 38*a*, an upper ridge 38*b*, a lower ridge 38*c*, and a distal tip 38*d* which are respectively similar to the distal portion 8*a*, the upper ridge 8*b*, the lower ridge 8*c*, and the distal tip 8*d* of the tongue piece 8 shown in FIG. 3.

The lower surface 33*m* of the catch piece 33*b* is pressed to the base surface 3*h* of the catch base 3*a* at the proximal side. Similar to the weft-holding portion 3 shown in FIGS. 2 to 6, a wedge-shaped gap 33*c* that is formed by the lower surface (the facing surface) 33*m* of the catch piece 33*b* and the base surface 3*h* of the catch base 3*a* defines a weft-holding portion 33. At the distal side with respect to the weft-holding portion 33, the weft path 11 opening toward the distal side is formed together with the wedge-shaped gap 33*c*. This embodiment differs from the embodiment shown in FIGS. 1 to 6 in that the tongue piece 38 is provided as a member separated from the catch piece 33*b* that defines the weft-holding portion 33. Also, in this embodiment, the opening and closing operation of the weft-holding portion 33 is not performed. The weft is held by being tucked into the wedge-shaped gap 33*c* defined by the catch piece 33*b* and the catch base 3*a*. The weft is released when the weft is spontaneously pulled out of the wedge-shaped gap 33*c* because the carrier rapier, to which the weft has been transferred, is retracted. Thus, the opening and closing operation of the catch piece 33*b* when the weft is transferred to the carrier rapier can be omitted.

Alternatively, this embodiment, in which the tongue piece 38 and the catch piece 33*b* are provided as the separate members as shown in FIGS. 8A and 8B, may be modified such that the tongue piece 38 and the catch piece 33*b* are individually movable. The tongue piece 38 and the catch piece 33*b* may be respectively provided at two levers that are individually rotatable. The tongue piece 38 and the weft-holding portion 33 may be driven at different timings. With this configuration, the movement of the tongue piece 38 and the timing for closing the catch piece 33*b* can be individually determined. Thus, the weft-holding state (the weft-holding tension) can be further precisely determined. In this case, the opener cam 17 that drives the lever may be preferably provided at a loom frame such that the position of the opener cam 17 is relatively adjustable in the weft-insertion direction.

Figure 9:
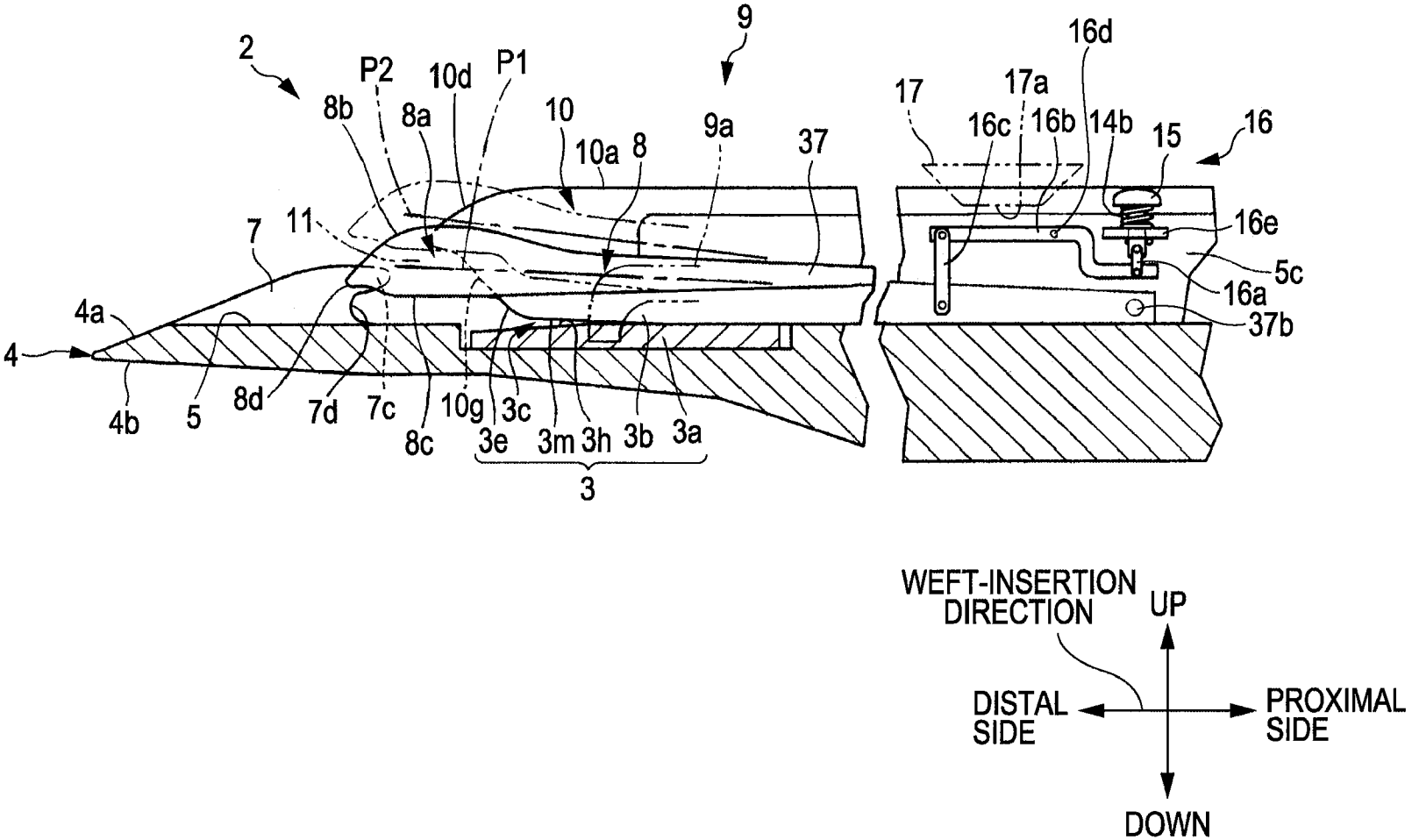
FIG. 9 is an enlarged side view showing an insert rapier according to still another embodiment of the present invention.

FIG. 9 illustrates an insert rapier according to still another embodiment of the present invention. In this embodiment, a tongue piece 8 and a catch piece 3*b* have shapes substantially similar to the tongue piece 8 and the catch piece 3*b* shown in FIGS. 2 to 6. Hence the same reference numerals are applied and the description thereof is omitted. In this embodiment, a displaceable pressure receiving member 15 and a motion transmitting portion 16 that is associated with the displacement of the pressure receiving member 15 are provided at the rapier head 2. The pressure receiving member 15 receives the force from the opener cam 17, and transmits the force to a lever 37 after the direction of the force is changed by a link 16*a*, a rocking lever 16*b*, and a link 16*c*, which serve as the motion transmitting portion 16. Accordingly, the tongue piece 8 is retracted upward (moved to the retraction portion P2).

In particular, the pressure receiving member 15 is inserted through a supporting portion 16*e* provided at the rear wall portion 5*c* and is slidable in the up-down direction. The pressure receiving member 15 is urged upward by a helical compression spring 14*b* (serving as an urging member). The pressure receiving member 15 can contact the opener cam 17. An end portion of the pressure receiving member 15 is coupled to one end of the rocking lever 16*b* through the link 16*a*.

The rocking lever 16*b* can rock around a shaft 16*d* located at the distal side with respect to a connecting point thereof with the pressure receiving member 15. The rocking lever 16*b* is coupled to the lever 37 through the link 16*c* at an end opposite to the connecting point with the pressure receiving member 15 with the shaft 16*d* interposed therebetween. The helical compression spring 14*b* urges the distal portion 8*a* of the tongue piece 8 in a direction to be recovered to the standby position P1. By traveling of the insert rapier 1, the opener cam 17 provided on the travel path of the rapier head 2 contacts the pressure receiving member 15, and the pressure receiving member 15 is pushed. Then, the rocking lever 16*b* rocks clockwise around the shaft 16*d*, and causes the lever 37 to be rotated upward around a shaft 37*b* through the link 16*c*. Accordingly, the tongue piece 8 (the weft-holding portion 3) is retracted upward (moved to the retracted position P2).

The inner configuration of the motion transmitting portion 16 is not limited to the configuration shown in FIG. 9, and may be modified. For example, the direction in which the pressure receiving member 15 is displaced (direction in which the pressure receiving member 15 is pushed) may not be the up-down direction as shown in FIG. 9, and may be the horizontal direction (the front-rear direction), and the motion transmitting portion 16 may be provided so as to convert the horizontal motion of the pressure receiving member 15 into the motion in the up-down direction. The lever 37 may be driven through such a motion transmitting portion 16.

Figure 10:
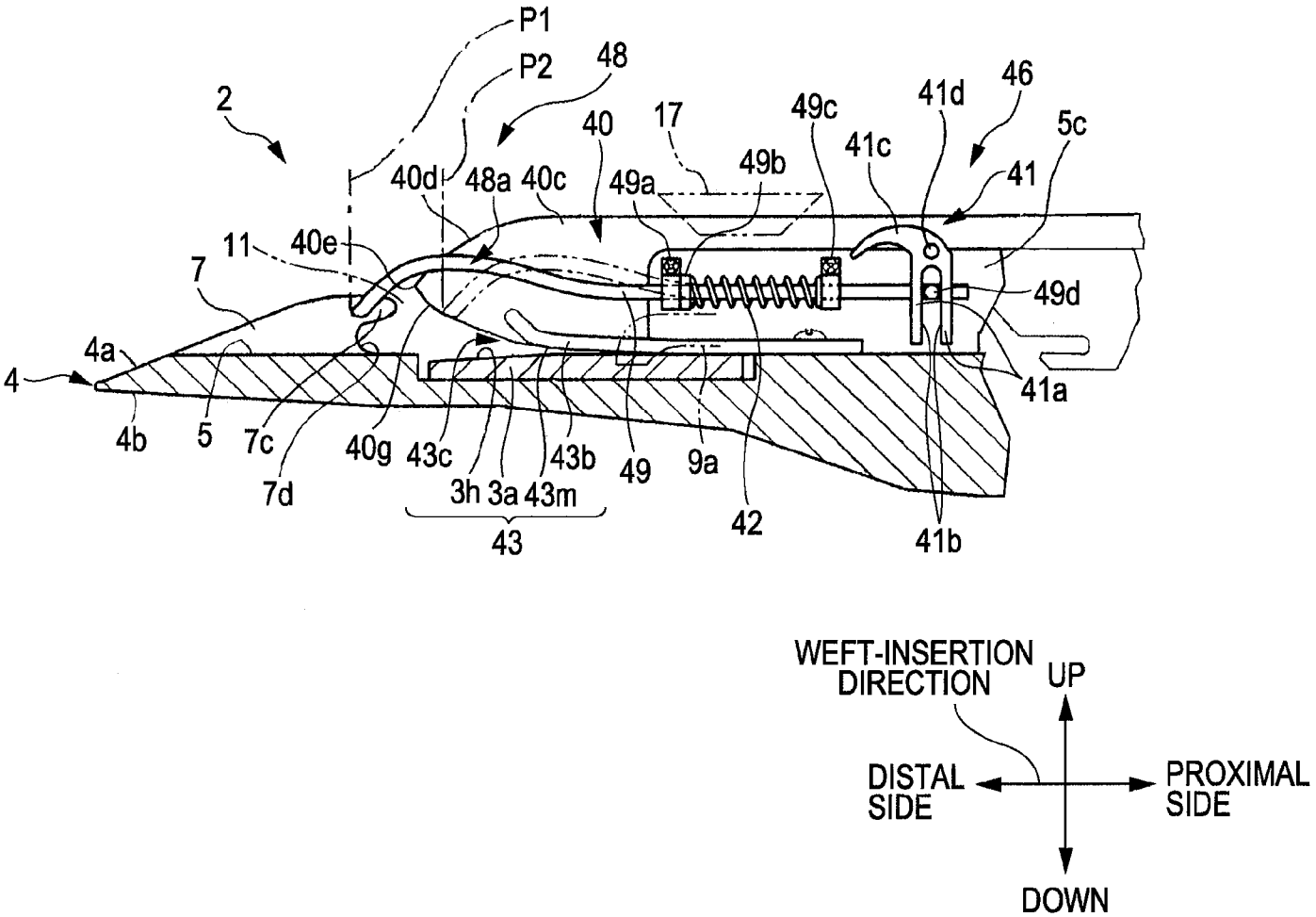
FIG. 10 is an enlarged side view showing an insert rapier according to yet another embodiment of the present invention.

FIG. 10 illustrates an insert rapier according to yet another embodiment of the present invention. The retracted position P2 of the tongue piece 8, 38 in any of the embodiments shown in FIGS. 1 to 9 is located above the rapier head 2. However, in this embodiment, a retracted position P2 of a tongue piece 48 is located at the proximal side of the rapier head 2. That is, the direction in which the tongue piece 48 is moved (the retracted position P2) is not limited to the upward direction of the rapier head 2. In this embodiment, the tongue piece 48 is provided at the distal end of a slide lever 49 extending in the longitudinal direction of the insert rapier 1. The slide lever 49 is supported so as to reciprocate in the longitudinal direction of the insert rapier 1. Also, an engagement pin 49*d* is provided at the proximal end of the slide lever 49. The engagement pin 49*d* engages with a pressure receiving member 41 having a lever-like shape (substantially L-like shape). In this embodiment, the engagement pin 49*d* and a branch portion 41*a* of the pressure receiving member 41 define a motion transmitting portion.

The slide lever 49 is urged toward the distal side of the rapier head 2 by a helical compression spring 42 serving as an urging member. The tongue piece 48 is urged such that a distal portion 48*a* of the tongue piece 48 is recovered to the standby position P1. The pressure receiving member 41 is urged clockwise around a rotation shaft 41*d* provided at the rear wall portion 5*c*. The pressure receiving member 41 has a pressure receiving portion 41*c* formed at the side opposite to the side engaged with the slide lever 49. The pressure receiving portion 41*c* can contact the opener cam 17. More specifically, a flange portion 49*b* contacts a supporting portion 49*a*, so that an advanced position (standby position P1) of the tongue piece 48 is regulated. The helical compression spring 42 serving as the urging member is arranged to contact the end surface of the flange portion 49*b* and a supporting portion 49*c* of the slide lever 49 at the proximal side in a properly compressed state. By traveling of the insert rapier 1, when the opener cam 17 provided on the travel path of the rapier head 2 contacts the pressure receiving member 41, the pressure receiving member 41 rocks counterclockwise around the rotation shaft 41*d*, and the slide lever 49, that is, the tongue piece 48 is retracted in the horizontal direction at the proximal side of the rapier head 2 through the engagement pin 49*d* (moved to the retracted position P2). At this time, in the side view of the rapier head 2, the distal portion 48*a* of the tongue piece 48 is moved to a position at which the tongue piece 48 does not overlap with the rear wall 7. More preferably, the distal portion 48*a* is moved to the position at the proximal side with respect to a lower ridge 40*g* of a head cover 40. In this embodiment, an engagement portion 41*b* provided at the branch portion 41*a* of the pressure receiving member 41, the engagement pin 49*d* of the slide lever 49 engaged with the engagement portion 41*b*, and the two supporting portions 49*a* and 49*c* supporting the slide lever 49 define a motion transmitting portion 46. In the motion transmitting portion 46, an engaging point between the engagement portion 41*b* and the engagement pin 49*d* slides in the rotation radius direction by the rocking motion of the pressure receiving member 41 because the opener cam 17 contacts the pressure receiving member 41. Thus, the motion transmitting portion 46 defines a slider crank mechanism that transmits only the displacement in the horizontal direction of the pressure receiving member 41 to the slide lever 49, i.e., defines a mechanism that transmits the motion to the slide lever 49 by converting the rocking motion of the pressure receiving member 41 into the reciprocating motion of the slide lever 49. In this embodiment, the tongue piece 48 and a catch piece 43*b* are provided as separate members. The catch piece 43*b* that is elastically deformable is fixed by a screw member (not shown), and hence the catch piece 43*b* is not opened or closed. The tongue piece 48 does not have a lower ridge, and guides the weft 20 to a weft-holding portion 43 by the lower ridge 40*g* of the head cover 40.

In the state in which the tongue piece 8, 38 has been moved to the retracted position P2, the configuration of the tongue piece 8, 38 that guides the weft 20 to the weft-holding portion 3, 33, and the configuration of the lower ridge of the head cover 10 are not limited to those described in the embodiments shown in FIGS. 1 to 6, 8, and 9. In any of the embodiments shown in FIGS. 1 to 6, 8, and 9, in the side view of the insert rapier 1, the lower ridge 8*c*, 38*c* of the tongue piece 8, 38 continuously extends to the lower ridge 10*g* of the head cover 10. The weft 20 is guided to the weft-holding portion 3, 33 while successively contacting the lower ridge 8*c*, 38*c* of the tongue piece 8, 38, and the lower ridge 10*g* of the head cover 10. However, a member different from the head cover 10 may have a function of guiding the weft 20 to the weft-holding portion 3, 33, like embodiments shown in FIGS. 11 to 13.

Figure 11:
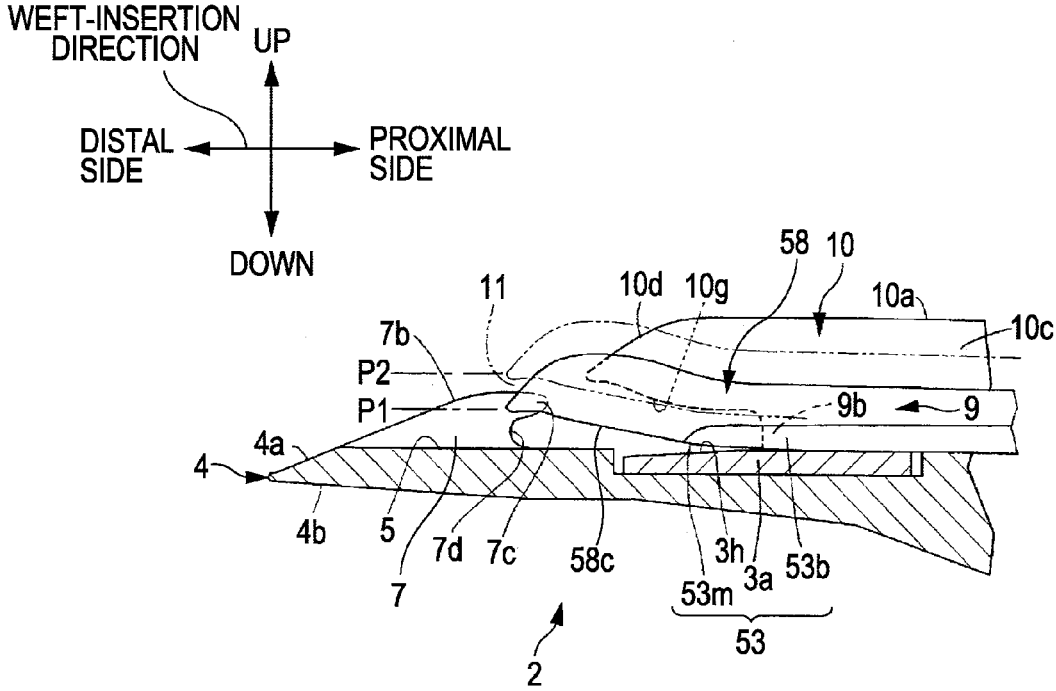
FIG. 11 is an enlarged side view showing an insert rapier according to a further embodiment of the present invention.

In particular, FIG. 11 shows an embodiment in which a tongue piece 58 further entirely extends toward the distal side as compared with the tongue piece 8 having the tongue-like shape extending in the up-down direction and in the longitudinal direction shown in FIGS. 3 to 6. Accordingly, even when the tongue piece 58 is moved to the retracted position P2, a lower ridge 58*c* of the tongue piece 58 is located closer to the distal side than the lower ridge 10*g* of the head cover 10 in the embodiment shown in FIGS. 3 to 6. Thus, the weft 20 contacts only the lower ridge 58*c* of the tongue piece 58.

Figure 12:
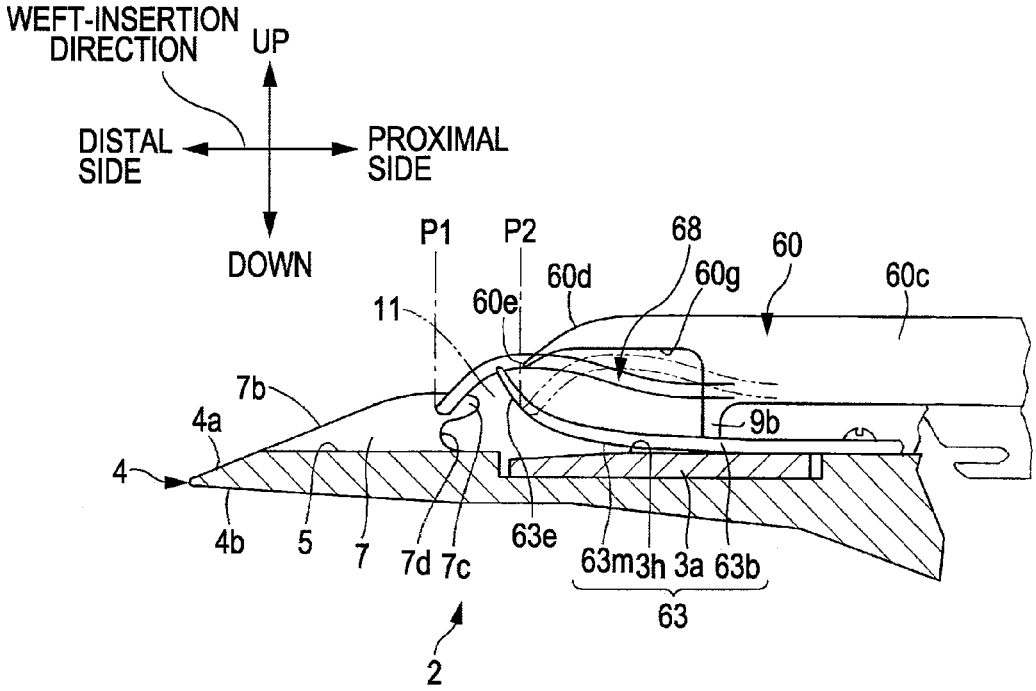
FIG. 12 is an enlarged side view showing an insert rapier according to a still further embodiment of the present invention.

FIG. 12 shows an embodiment different from the embodiment in FIG. 10 in that a front side wall 60*c* continuously extending to an upper ridge 60*d* of a head cover 60 is slightly narrowed toward the proximal side and toward the upper wall side. Thus, a lower ridge 60*g* of the head cover 60 is retracted from the bottom portion 5. Also, the distal end of a catch piece 63*b* further extends to a position between the protrusion 7*c* of the rear wall 7 and a distal tip 60*e* of the head cover 60 toward the distal side and upward. Accordingly, the weft 20 can be guided to a weft-holding portion 63 only by a lower ridge 63*e* of the catch piece 63*b*.

Alternatively, the weft 20 may be guided to the weft-holding portion 3 by bringing the weft 20 into contact only with the lower ridge of the head cover 10, 40, 60. For example, in the embodiment shown in FIG. 10, a front side wall 40*c* continuously extending to an upper ridge 40*d* of the head cover 40 extends downward in a region at the proximal side from a distal tip 40*e*. The lower ridge 40*g* of the head cover 40 is located at a position close to a wedge-shaped gap 43*c* of the weft-holding portion 43. Accordingly, the weft 20 can contact only the lower ridge 40*g* of the head cover 40.

Figure 13:
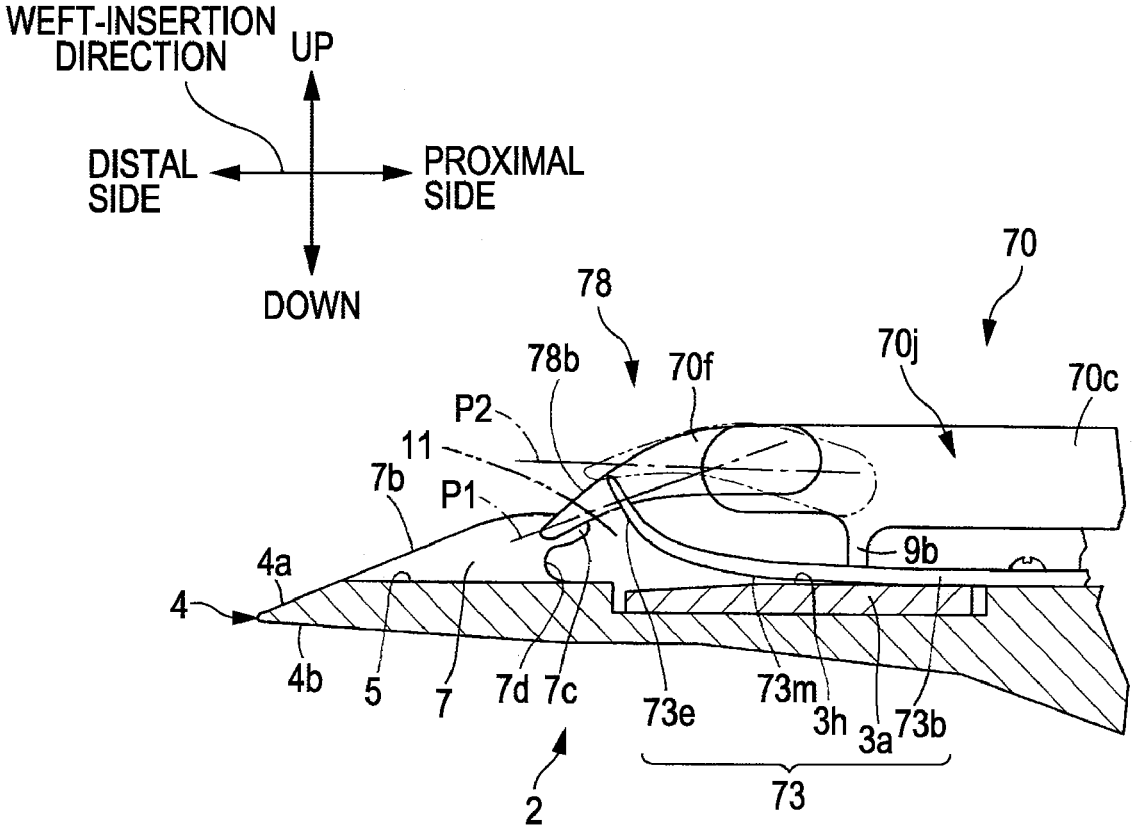
FIG. 13 is an enlarged side view showing an insert rapier according to a yet further embodiment of the present invention.

In any of the embodiments shown in FIGS. 1 to 12, the tongue piece 8, 38, 48, 58, 68 is provided at the side of the catch piece 3*b*, 53*b*, or is provided as a member separated from the catch piece 33*b*, 43*b*, 63*b*. However, the tongue piece 8, 38, 48, 58, 68 may be provided at the head cover 10, 40, 60. FIG. 13 shows an embodiment in which a head cover 70 is formed of two members including a distal member 70*f* serving as a tongue piece 78, and a proximal member 70*j*. The distal member 70*f* is inserted through a guide hole (not shown) formed in a front side wall 70*c* of the proximal member 70*j*, and supported by the proximal member 70*j*. Also, the distal member 70*f* is coupled to a motion transmitting portion (not shown) like the above-described embodiments. The distal member 70*f* receives the reciprocating driving from the motion transmitting portion, is guided through the guide hole, and hence is movable from the standby position P1 to the retracted position P2. The distal member 70*f* is moved upward and allows the weft path 11 to be opened. In this embodiment, the weft 20 is guided only by a lower ridge 73*e* of a catch piece 73*b*. An upper ridge 78*b* of the distal member 70*f* of the head cover 70 serves as the tongue piece 78. However, only one of an upper wall and a side wall which define the upper ridge 78*b* may serve as the tongue piece 78.

Figure 14:
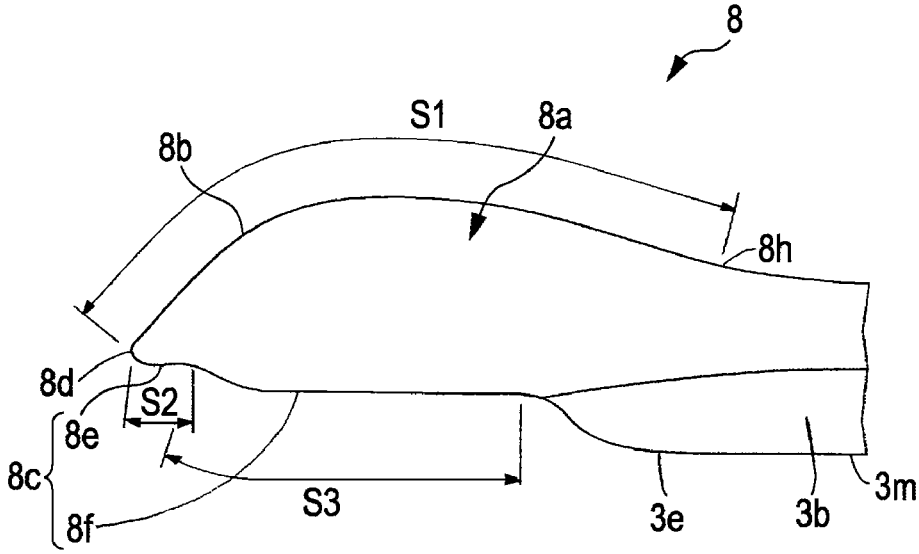
FIG. 14 is an enlarged side view showing a tongue piece of an insert rapier according to an embodiment of the present invention.

The specific shape of the lower ridge 8*c*, 38*c*, 58*c* of the tongue piece 8, 38, 58 has not been described, and hence the specific example will be described below. FIG. 14 illustrates the tongue piece 8 according to the embodiment shown in FIGS. 1 to 6. Regarding the shape of the lower side of the tongue piece 8, in the side view of the insert rapier 1, the lower side continuously extends from the distal tip 8*d* of the tongue piece 8, through the lower ridge 8*c* of the tongue piece 8, to the lower surface 3*m* of the catch piece 3*b*. The lower ridge 8*c* of the tongue piece 8 includes a section S2 extending from the distal tip 8*d* of the tongue piece 8 toward the proximal side by a certain length, and a section S3 connecting with the section S2. A retraction portion 8*e* is formed in the section S2. In the retraction portion 8*e*, the degree of descending is reduced for a certain length from the distal tip 8*d* toward the proximal side. An introduction portion 8*f* is formed in the section S3. The introduction portion 8*f* continuously extends to the retraction portion 8*e* and the lower surface 3*m* of the catch piece 3*b* while descending. Accordingly, in the state in which the tongue piece 8 has been moved to the retracted position P2 (in the state shown in FIG. 5), the weft 20 can be prevented from being detached from the weft path 11 because the weft 20 is repelled when contacting the position close to the distal tip 8*d*, as compared with a lower ridge that continuously descends from the distal tip 8*d* of the tongue piece 8 without the retraction portion 8*e* provided at the lower ridge 8*c*. Also, by expanding the weft path 11 which is the space between the lower ridge 8*c* of the tongue piece 8 at the retracted position P2 and the rear wall 7 at the retracted position P2, the weft 20 can be reliably guided to the weft-holding portion 3. The retraction portion 8*e* does not have to extend from the distal tip 8*d* in a substantially linear form like the embodiment shown in FIG. 14. The retraction portion 8*e* may have an upward protrusion, or a downward protruding curve with a reduced degree of descending. Although the length of the retraction portion 8*e* is limited by the entire shape of the tongue piece 8, the length of the second S2 may by at least 0.5 mm. The introduction portion 8*f* may have a curve continuously extending to the region in which the weft 20 is guided by the lower ridge 10*g* of the head cover 10 as shown in FIG. 5. Alternatively, the introduction portion 8*f* may be provided in a linear form toward the lower surface 3*m* of the catch piece 3*b* as shown in FIG. 11.

Figure 15:
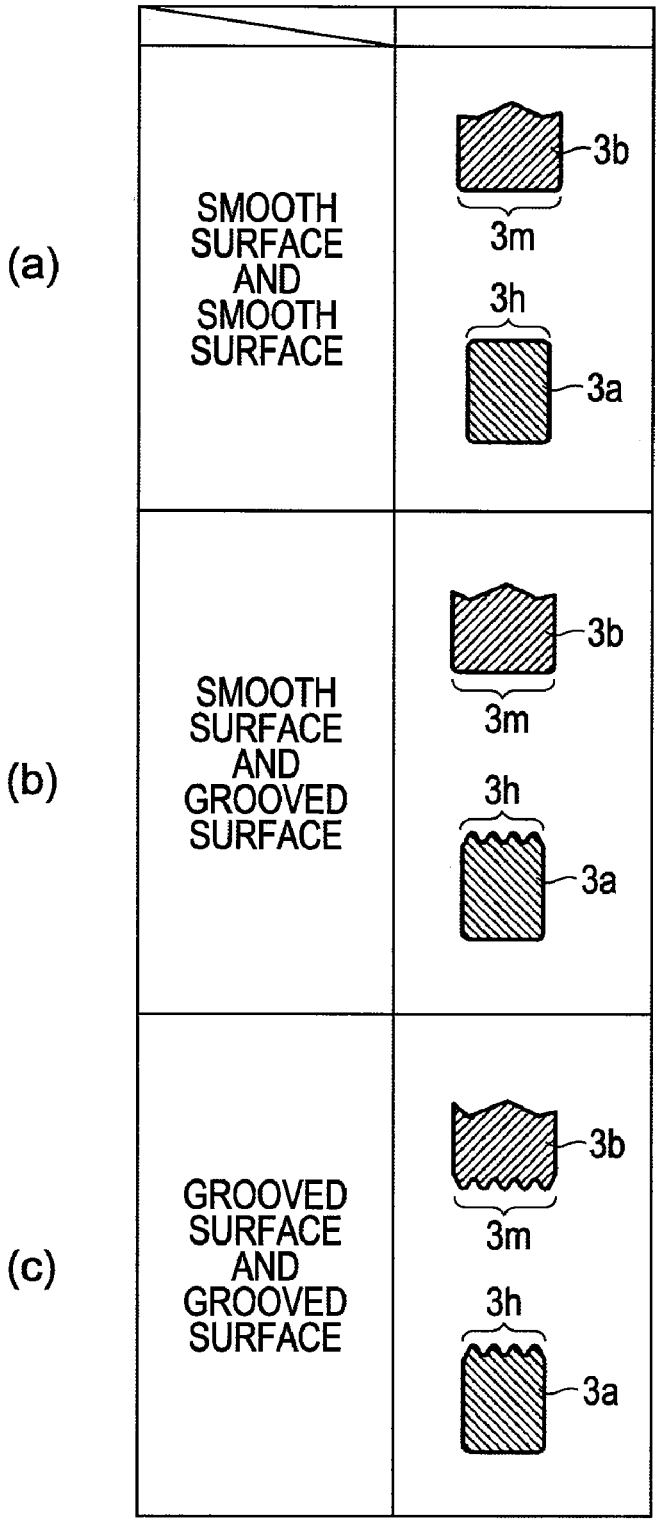
FIG. 15 illustrates cross sections of catch bases and catch pieces included in weft-holding portions taken along a vertical plane containing a warp direction.
Figure 16:
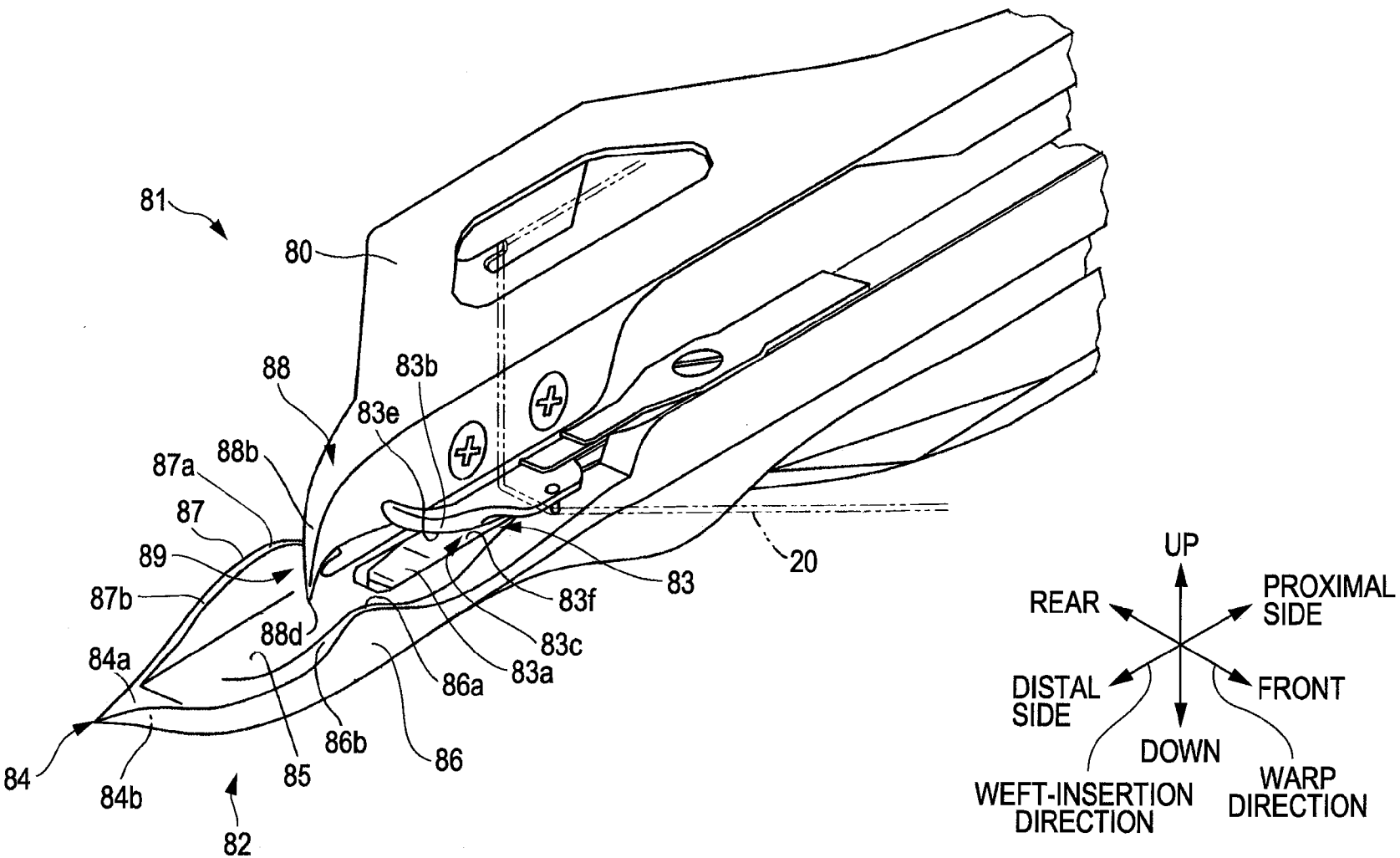
FIG. 16 is a perspective view showing an insert rapier of related art.

The base surface (the upper surface) 3*h* of the catch base 3*a*, and the lower surface (the facing surface) 3*m*, 33*m*, 43*m*, 53*m*, 63*m*, 73*m* of the catch piece 3*b*, 33*b*, 43*b*, 53*b*, 63*b*, 73*b*, which define the weft-holding portion 3, 33, 43, 53, 63, 73, may not respectively have shapes having smooth surfaces. The following shapes are included in this specification. The weft-holding portion 3 will be representatively described below. However, the same can be applied to the weft-holding portion 33 and the like. Parts (a) to (c) in FIG. 15 are cross-sectional views showing weft-holding portions 3 respectively taken along vertical planes orthogonal to the longitudinal directions of base surfaces 3*h* of catch bases 3*a* and lower surfaces (facing surfaces) 3*m* of catch pieces 3*b*. The cross-sectional shapes of these members and their combinations are illustrated. Part (a) in FIG. 15 illustrates an example in which both the base surface 3*h* of the catch base 3*a* and the lower surface 3*m* of the catch piece 3*b* have smooth surfaces. Part (b) in FIG. 15 illustrates an example in which a plurality of V grooves are formed only in the base surface 3*h* of the catch base 3*a*. Alternatively, a plurality of V grooves may be formed only in the lower surface 3*m* of the catch piece 3*b*. Part (c) in FIG. 15 illustrates an example in which a plurality of V grooves are formed in both the base surface 3*h* of the catch base 3*a* and the lower surface 3*m* of the catch piece 3*b*, and the V grooves of the base surface 3*h* engage with the V grooves in the lower surface 3*m*. Alternatively, regarding the example shown in part (c) in FIG. 15, for example, the ridge parts of the V grooves in the base surface 3*h* may face the ridge parts of the V grooves in the lower surface 3*m*. Any of such smooth surfaces and such triangular-waveform end surfaces formed of the plurality of V grooves serves as a weft-holding surface to hold a weft. Such a surface is formed at least in the region in which the wedge-shaped gap 3*c* is formed. Alternatively, such a surface may be continuously formed on the entire surface in the longitudinal direction of the base surface 3*h* of the catch base 3*a* and the lower surface 3*m* of the catch piece 3*b*. The shape of the grooves is not limited to the V-shape, and may be rectangular waveform, serrate form, U-shape, or waveform.

In the above-described embodiment, the plurality of grooves are formed in one or either of the facing surfaces of the catch base 3*a* and the catch piece 3*b*, which define the weft-holding portion 3. Alternatively, one of the facing surfaces may have a groove and the other may have a protrusion that is fitted into the groove, to define the weft-holding portion 3. As long as at least one of the base surface 3*h* of the catch base 3*a* and the lower surface 3*m* of the catch piece 3*b* has a groove, a weft can be tucked into the groove. Thus, the weft-holding force of the weft-holding portion 3 can be increased.

Further, the driving of the tongue piece 8 is not limited to the opening and closing driving by the opener cam 17 provided on the travel path of the rapier head 2. For example, the opening and closing driving may be performed by applying electricity to an electric actuator for driving arranged in the rapier head 2. For another example, the driving may be provided by a driving device provided in a loom frame, the driving device controlling the position of the opener cam 17 by using an electric actuator. When the driving is performed by the electric actuator, a weft selection signal of a loom may be preferably used to move the tongue piece 8 only when a weft that is difficult to be guided by the insert rapier 1 is selected. Accordingly, the number of operations of a motion transmitting portion, such as a lever, for moving the tongue piece 8 can be decreased, and hence wearing of a spindle portion that supports these members can be reduced. The life of the insert rapier 1 can be increased.

In the above-described embodiment, the pressure receiving portion 12 or the like that protrudes upward contacts the opener cam 17 that protrudes downward. However, these members may protrude laterally to contact one another.

What is claimed is:

1. An insert rapier that is used for a both-side rapier loom and transfers a weft to a carrier rapier, the insert rapier comprising:

a rapier head having a bottom portion; and a weft-holding portion provided at the bottom portion of the rapier head, wherein the rapier head includes hill-like rear and front walls provided at a distal side of the rapier head with respect to the weft-holding portion and protruding upward from both sides of the bottom portion of the rapier head, and a tongue piece extending from a position closer to the weft-holding portion than the rear and front walls to a region between the rear and front walls, wherein the front and rear walls partly overlap with one another in a side view of the rapier head, wherein a distal tip of a distal portion of the tongue piece is located in the overlapping region; an upper ridge of the distal portion of the tongue piece gradually ascends from the distal tip of the tongue piece toward a proximal side of the tongue piece; and the front wall, the rear wall, and the tongue piece define a warp-dividing portion, and wherein the tongue piece of the insert rapier is movable from a standby position to a retracted position, which is above the rapier head or at a distal side of the rapier head, in the side view of the rapier head; and the tongue piece is moved to the retracted position before the weft passes the distal tip of the tongue piece.

2. The insert rapier according to claim 1, wherein the tongue piece is provided at a distal end of a lever that is rotatable in an up-down direction.

3. The insert rapier according to claim 2, wherein the weft-holding portion includes a catch base provided at the bottom portion of the rapier head and having a base surface, and a catch piece having a lower surface that faces the base surface of the catch base, the catch piece configured to hold the weft between the base surface and the lower surface, wherein the catch piece is provided at the lever that is rotatable in the up-down direction, and wherein the tongue piece is provided at a side of the catch piece.

4. The insert rapier according to claim 3, wherein the distal portion of the tongue piece has a lower ridge extending from the distal tip of the tongue piece toward the distal side, the lower ridge of the tongue piece continuously extending to a lower ridge of the catch piece in the side view of the rapier head.

5. The insert rapier according to claim 3, wherein a wedge-shaped gap is formed between the base surface of the catch base and the lower surface of the catch piece, the gap being open in an advance direction and configured to hold the weft, wherein the wedge-shaped gap is configured to be expanded because the lower surface of the catch piece is separated from the base surface of the catch base when the tongue piece is moved to the retracted position, and wherein a weft stopper is provided at a side of the catch base, the weft stopper configured to determine a holding position of the weft in the wedge-shaped gap, the weft stopper provided such that the weft is arranged on the lower surface of the catch piece when the weft is stopped by the weft stopper after the weft, which has been introduced to the wedge-shaped gap, passes the distal tip of the tongue piece.

6. The insert rapier according to claim 5, wherein the position of the weft stopper is adjustable relative to the catch base in a longitudinal direction of the rapier head.

7. The insert rapier according to claim 1, further comprising:

a head cover provided at a side of the rapier head provided with the rear wall, the head cover extending in a longitudinal direction of the rapier head, wherein the head cover includes an upper wall, and a rear side wall and a front side wall protruding downward from both sides of the upper wall, wherein the rear side wall has a weft guide that regulates the position of the weft when the weft is transferred to the carrier rapier, and wherein the front side wall has an upper ridge gradually descending toward the distal side of the rapier head, and a distal tip connecting with the upper ridge; the upper ridge of the distal portion of the tongue piece continuously extends to the upper ridge of the head cover in the side view of the rapier head in a state in which the tongue piece is located at the standby position; and the upper wall, the front side wall, the upper ridge of the distal portion of the tongue piece, and an upper ridge of the rear wall continuously extend to a distal portion of the rapier head.

8. The insert rapier according to claim 7, wherein the tongue piece is arranged between the head cover and the catch piece in a top view of the insert rapier, and wherein the lower ridge of the tongue piece is separated from the upper ridge of the rear wall in the side view of the rapier head in a state in which the tongue piece has been moved to the retracted position, and the lower ridge of the tongue piece, the upper ridge of the rear wall, and an upper ridge of the font wall define a weft path communicating with the weft-holding portion.

9. The insert rapier according to claim 7, wherein the rear wall of the rapier head has a protrusion that protrudes toward the proximal side of the rapier head from a top of the rear wall, the protrusion having a lower ridgeline, which is directed toward the distal side, then toward the proximal side, and connects with the bottom portion of the rapier head, to form a recessed weft-contacting portion configured to contact the weft when the weft is transferred to the carrier rapier, and wherein a lower ridge of the head cover and the lower ridge of the tongue piece do not overlap with the protrusion of the rear wall in the side view of the rapier head in a state in which the tongue piece has been moved to the retracted position, and the lower ridge of the head cover, the lower ridge of the tongue piece, the protrusion of the rear wall, and the upper ridge of the front wall define a weft path communicating with the weft-holding portion.

10. The insert rapier according to claim 1, wherein, in a state in which the tongue piece is located at the standby position, the distal tip of the tongue piece is located higher than the weft when the weft extending at a predetermined angle to a warp direction is relatively moved while being in contact with an upper ridge of the rear wall and an upper ridge of the front wall by traveling of the insert rapier.

11. The insert rapier according to claim 2, wherein the lever provided with the tongue piece has a pressure receiving portion at an end of the lever, the pressure receiving portion protruding above the rapier head, the lever being urged by an urging member such that the distal portion of the tongue piece is recovered to the standby position, wherein the insert rapier is used for a rapier loom in which an opener cam is arranged on a travel path of the rapier head such that the opener cam can contact the pressure receiving portion, and wherein the tongue piece is moved to the retracted position because the pressure receiving portion contacts the opener cam before the weft passes the distal tip of the tongue piece.

12. The insert rapier according to claim 2, wherein the rapier head includes a displaceable pressure receiving member, and a motion transmitting portion that moves the tongue piece in association with the displacement of the pressure receiving member, wherein the tongue piece is urged by an urging member such that the distal portion of the tongue piece is recovered to the standby position, wherein the insert rapier is used for a rapier loom in which an opener cam is arranged on a travel path of the rapier head such that the opener cam can contact the pressure receiving portion, and wherein the pressure receiving member contacts the opener cam and is displaced before the weft passes the distal tip of the tongue piece, and the pressure receiving member moves the tongue piece to the retracted position through the motion transmitting portion.

13. The insert rapier according to claim 1, wherein the tongue piece is provided at a distal end of a slide lever extending in a longitudinal direction and supported movably in the longitudinal direction.

14. The insert rapier according to claim 13, wherein the rapier head includes a displaceable pressure receiving member, and a motion transmitting portion that associates with the displacement of the pressure receiving member, wherein the tongue piece is urged by an urging member such that the distal portion of the tongue piece is recovered to the standby position, wherein the insert rapier is used for a rapier loom in which an opener cam is arranged on a travel path of the rapier head such that the opener cam can contact the pressure receiving portion, and wherein the pressure receiving member contacts the opener cam and is displaced before the weft passes the distal tip, and the pressure receiving member moves the tongue piece to the retracted position through the motion transmitting portion.

* * * * *